US007687733B2

(12) United States Patent
Weister et al.

(10) Patent No.: US 7,687,733 B2
(45) Date of Patent: Mar. 30, 2010

(54) INTERLOCK ASSEMBLY FOR A STORED ENERGY MECHANISM

(75) Inventors: Nathan J. Weister, Darlington, PA (US); Paul R. Rakus, Beaver Falls, PA (US); Roger J. Briggs, Colgate, WI (US); Perry R. Gibson, East Palestine, OH (US); Robert M. Slepian, Murrysville, PA (US); Douglas C. Marks, Murrysville, PA (US); Yuri C. Spitsberg, Export, PA (US)

(73) Assignee: Eaton Corporation, Cleveland, OH (US)

( * ) Notice: Subject to any disclaimer, the term of this patent is extended or adjusted under 35 U.S.C. 154(b) by 453 days.

(21) Appl. No.: 11/758,789

(22) Filed: Jun. 6, 2007

(65) Prior Publication Data

US 2008/0302640 A1 Dec. 11, 2008

(51) Int. Cl.
*H01H 5/00* (2006.01)

(52) U.S. Cl. ..... 200/400

(58) Field of Classification Search ..... 200/400, 200/401; 74/97.1

See application file for complete search history.

(56) References Cited

U.S. PATENT DOCUMENTS 5,856,643 A * 1/1999 Gress et al. ..... 200/400
5,899,323 A * 5/1999 Rakus ..... 200/244
7,459,650 B2 * 12/2008 Weister et al. ..... 200/400

* cited by examiner

*Primary Examiner*—Felix O Figueroa
(74) *Attorney, Agent, or Firm*—Martin J. Moran

(57) ABSTRACT

The stored energy device interlock assembly provided is structured to prevent the closing assembly and/or the latch assembly from being actuated in selected configurations. The interlock assembly includes a latch D-shaft link assembly, an on-command paddle assembly, and an on-command paddle actuator. The latch D-shaft link assembly is pivotally coupled to, and structured to rotate, the latch assembly D-shaft. The on-command paddle assembly is structured to move the D-shaft link assembly. The on-command paddle actuator is structured to move the on-command paddle assembly. The interlock assembly is structured to disengage the latch assembly D-shaft from the on-command paddle assembly in selected configurations of the electrical switching apparatus. The interlock assembly provided herein has two pivotal degrees of freedom as opposed to a pivotal degree of freedom and a sliding degree of freedom.

20 Claims, 13 Drawing Sheets

INTERLOCK ASSEMBLY FOR A STORED ENERGY MECHANISM

BACKGROUND OF THE INVENTION

1. Field of the Invention

The present invention relates to an electrical switching apparatus operating mechanism and, more specifically to an interlock assembly that prevents the actuation of the latch assembly in configurations wherein the closing assembly should not be actuated.

2. Background Information

An electrical switching apparatus, typically, includes a housing, at least one bus assembly having a pair of contacts, a trip device, and an operating mechanism. The housing assembly is structured to insulate and enclose the other components. The at least one pair of contacts include a fixed contact and a movable contact and typically include multiple pairs of fixed and movable contacts. Each contact is coupled to, and in electrical communication with, a conductive bus that is further coupled to, and in electrical communication with, a line or a load. A trip device is structured to detect an over current condition and to actuate the operating mechanism. An operating mechanism is structured to both open the contacts, either manually or following actuation by the trip device, and close the contacts.

That is, the operating mechanism includes both a closing assembly and an opening assembly, which may have common elements, that are structured to move the movable contact between a first, open position, wherein the contacts are separated, and a second, closed position, wherein the contacts are coupled and in electrical communication. The operating mechanism includes a rotatable pole shaft that is coupled to the movable contact and structured to move each movable contact between the closed position and the open position. Elements of both the closing assembly and the opening assembly are coupled to the pole shaft so as to effect the closing and opening of the contacts. The closing assembly may be actuated manually by a user input or in response to an input from a remote actuator.

The trip device included an over-current sensor, a latch assembly and may have included one or more additional links that were coupled to the toggle assembly. Alternately, the latch assembly was directly coupled to the toggle assembly. When an over-current situation occurred, the latch assembly was released allowing the opening spring to cause the toggle assembly to collapse. When the toggle assembly collapsed, a closing spring coupled to the pole shaft caused the pole shaft to rotate and thereby move the movable contacts into the open position.

Low and medium voltage electrical switching apparatus typically had stored energy devices, such as a closing spring and an opening spring, and at least one link coupled to the pole shaft. The at least one link, typically, included two links that acted cooperatively as a toggle assembly and which were coupled to each other at a toggle joint. When the contacts were open, the toggle assembly was in a first, collapsed configuration and, conversely, when the contacts were closed, the toggle assembly was, typically, in a second, toggle position, that is, an in-line configuration, or in a slightly over-toggle position. The closing spring was usually compressed, or "charged," by a motor or a user utilizing a lever arm. The closing spring, typically, holds more stored energy than the opening springs and during the closing operation wherein the contacts are moved to the second, closed position, the opening spring was charged. The opening spring biased the pole shaft, and therefore the toggle assembly, to the collapsed position. The opening spring and toggle assembly were maintained in the second, toggle position by the trip device.

Typically, the closing spring is recharged immediately after a closing procedure was completed. Thus, the closing assembly was set to be actuated in the event the contacts were opened, e.g. upon a trip. The closing assembly was typically actuated by a remote device or by an "on" button disposed on the face of the electrical switching apparatus. The remote device and/or the on button is coupled to a closing assembly latch, which typically included a D-shaft against which a latch member was biased by force from the closing springs. Actuation of the closing assembly caused the D-shaft to rotate and allowed the latch member to rotate thereby releasing the closing springs.

However, having the closing spring in a charged state could also result in damage to the operating mechanism if the closing spring was released too often while the contacts were closed. That is, if the closing spring was released by a user pressing the on button when the contacts were closed, energy from the spring would cause the various components of the closing assembly to, possibly, impact upon each other without the benefit of the energy being dissipated to the opening springs or contact springs or other such components. Furthermore, if the closing spring was inappropriately released when the contacts were closed, then electrical switching apparatus tripped and then called on to immediately re-close, a non-charged closing spring could result in a delay of service. There are other circumstances wherein the closing assembly should not be activated. For example, immediately after a closing procedure the closing spring should be fully recharged and latched prior to releasing the closing spring again. However, if a user were to hold the on button during the recharging procedure, the closing spring could not be latched and, as soon as the charging operation was completed, the closing spring would discharge. That is, there should be only one attempt to release the closing springs per application of the on button and that attempt should only occur when the closing springs are charged and permitted to close. For example, the closing spring should not be permitted to close when the trip device is used to keep the contacts in the open state. For example, when an electrical switching apparatus is being worked upon, a safety interlock typically holds the trip device in a tripped configuration, thereby ensuring the contacts are in the first open position. Generally, in such a situation, the contacts should not be closed by the closing assembly and the closing springs should not be allowed to discharged. Thus, generally, any time the contacts are closed, or when the contacts should be kept open, a close command by the closing assembly should not be allowed to close the contacts.

To prevent accidental closure of the contacts in these situations, electrical switching apparatuses included an interlock. The interlock was structured to decouple the on button, or a remote actuator, from the latch assembly D-shaft. Once the actuation device was decoupled from the latch assembly D-shaft, pressing the on button or actuating the remote actuator had no effect on the latch assembly D-shaft. The interlock typically relied upon a link structured to pivot and to slide. That is, the link included an elongated slot through which a pivot pin extended. This allowed the link to move with two degrees of freedom, i.e., (1) pivoting and (2) sliding.

Such an interlock would operate, generally, in the following manner. With the pivot pin at one end of the slot, the link was disposed adjacent to the D-shaft. When the actuator, that is the on button or the remote actuator, was actuated, the link would pivot to operatively engage the D-shaft and cause the D-shaft to rotate thereby releasing the latch and the closing spring. When the closing assembly should not have been allowed to close the contacts, the interlock moved the link so that the pivot pin was disposed at the other end of the slot. This motion spaced the link from the D-shaft and/or the actuator. Thus, when the on button or the remote actuator was actuated, the subsequent pivoting motion of the link did not cause the link to engage the D-shaft/actuator as the link was now spaced from the D-shaft/actuator. As such, the interlock prevented the contact from being closed as a result of actuating the on button or the remote actuator. It is noted that the interlock could also be structured so that the sliding motion actuated the D-shaft and the pivoting motion separated the link from the D-shaft.

SUMMARY OF THE INVENTION

The stored energy device interlock assembly provided herein is structured to prevent the closing assembly and/or the latch assembly from being actuated in selected configurations. The interlock assembly includes a latch D-shaft link assembly, an on-command paddle assembly, and an on-command paddle actuator. The latch D-shaft link assembly is pivotally coupled to, and structured to rotate, the latch assembly D-shaft. The on-command paddle assembly is structured to move the D-shaft link assembly. The on-command paddle actuator is structured to move the on-command paddle assembly. The interlock assembly is structured to disengage the latch assembly D-shaft from the on-command paddle assembly in selected configurations of the electrical switching apparatus. Unlike the prior art interlock assembly, however, the interlock assembly provided herein has two pivotal degrees of freedom as opposed to a pivotal degree of freedom and a sliding degree of freedom. As such, the interlock assembly provided herein is more robust and easier to control.

That is, because the latch D-shaft link assembly is pivotally coupled to the latch assembly D-shaft, the latch D-shaft link assembly may pivot about the axis of the latch assembly D-shaft, which is the first pivotal degree of freedom, and the latch D-shaft link assembly may pivot about the coupling point with the latch assembly D-shaft, which is the second pivotal degree of freedom. The latch D-shaft link assembly includes a "nose" disposed generally opposite of the pivotal coupling with the latch assembly D-shaft.

The on-command paddle assembly includes a body defining a pocket with two sides. When the interlock assembly should allow the latch assembly D-shaft to rotate and release the closing springs, the latch D-shaft link assembly nose is disposed in the pocket. Thus, when the on-command paddle actuator moves the on-command paddle assembly, the latch D-shaft link assembly moves which in turn rotates the latch assembly D-shaft. When the interlock assembly should not allow the latch assembly D-shaft to rotate and release the closing springs, the interlock assembly causes the latch D-shaft link assembly to rotate about the coupling point with the latch assembly D-shaft until the latch D-shaft link assembly nose is no longer disposed in the pocket. Thus, while actuation of the on-command paddle actuator still moves the on-command paddle assembly, the on-command paddle assembly no longer engages the latch D-shaft link assembly. Thus, the latch D-shaft link assembly does not move and the latch assembly D-shaft is not rotated.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As used herein, "coupled" means a link between two or more elements, whether direct or indirect, so long as a link occurs.

As used herein, "directly coupled" means that two elements are directly in contact with each other.

As used herein, "fixedly coupled" or "fixed" means that two components are coupled so as to move as one.

As used herein, "operatively engage" when used in relation to a component that is directly coupled to a cam means that a force is being applied by that component to the cam sufficient to cause the cam to rotate. "Operatively engage" is also synonymous with the phrase "engage and move." That is, "operatively engage" when used in relation to a first component that is structured to move a movable or rotatable second component means that the first component applies a force sufficient to cause the second component to move. For example, a screwdriver may be placed into contact with a screw. When no force is applied to the screwdriver, the screwdriver merely engages the screw. However, when a rotational force is applied to the screwdriver, the screwdriver operatively engages the screw and causes the screw to rotate.

As used herein, a "pivot coupling" is a structure that allows two, or more, components to be pivotally or rotatably coupled together. A pivot coupling that pivotally or rotatably coupled together a first element and second element includes two coupling components, a first coupling component disposed on the first element and a second coupling component disposed on the second element. The coupling components are typically an opening and a pivot rod, however other components, such as, but not limited to a collar trapped in a race, are contemplated. It is noted that the coupling components are typically reversible. That is, a pivot coupling may have an opening on the first element and a pivot rod on the second element, or, the same pivot coupling may have a pivot rod on the first element and an opening on the second element. When two elements are coupled at a pivot coupling a pivot point is created.

Figure 1:
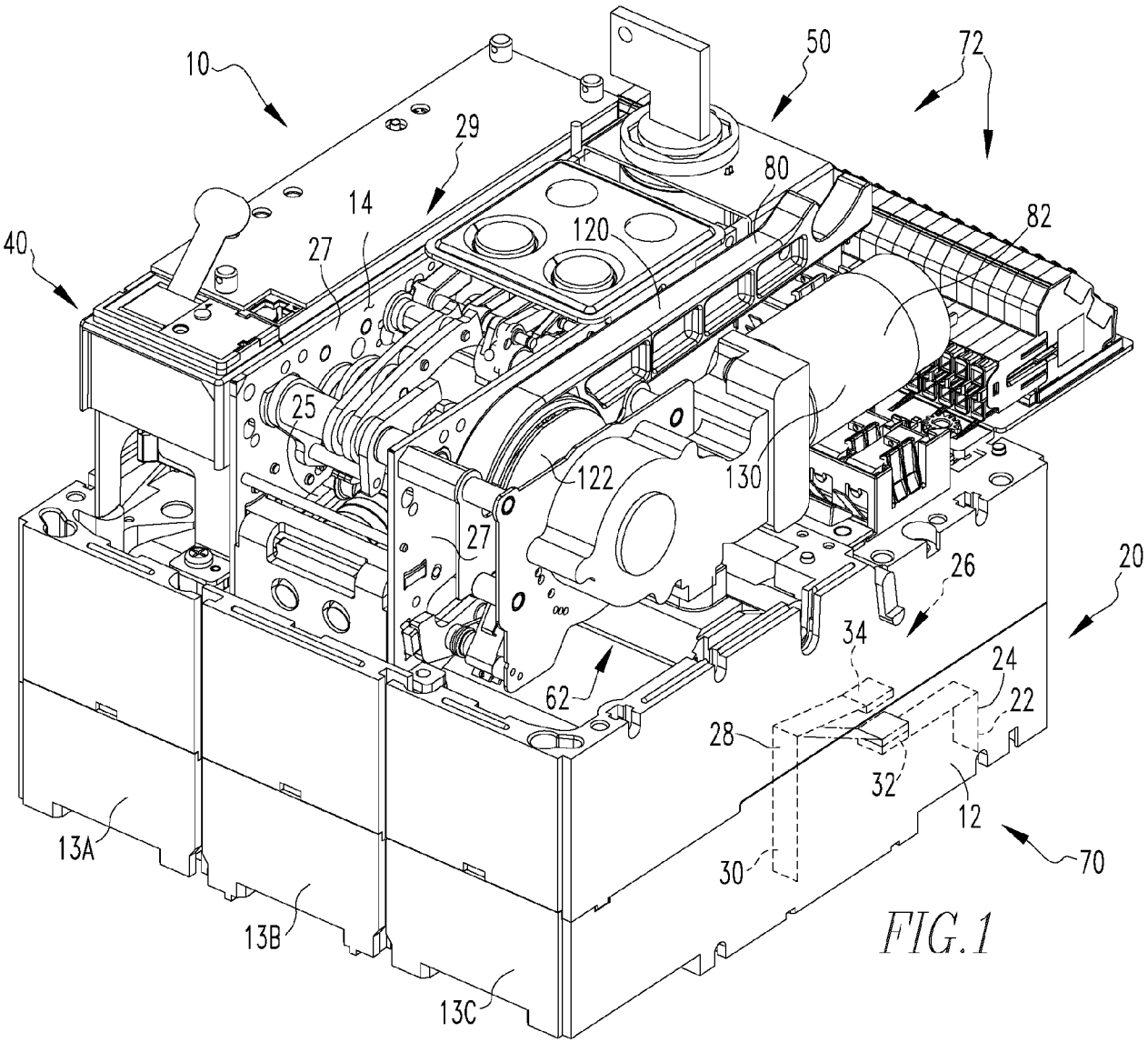
FIG. 1 is an isometric view of an electrical switching apparatus with a front cover removed.
Figure 6:
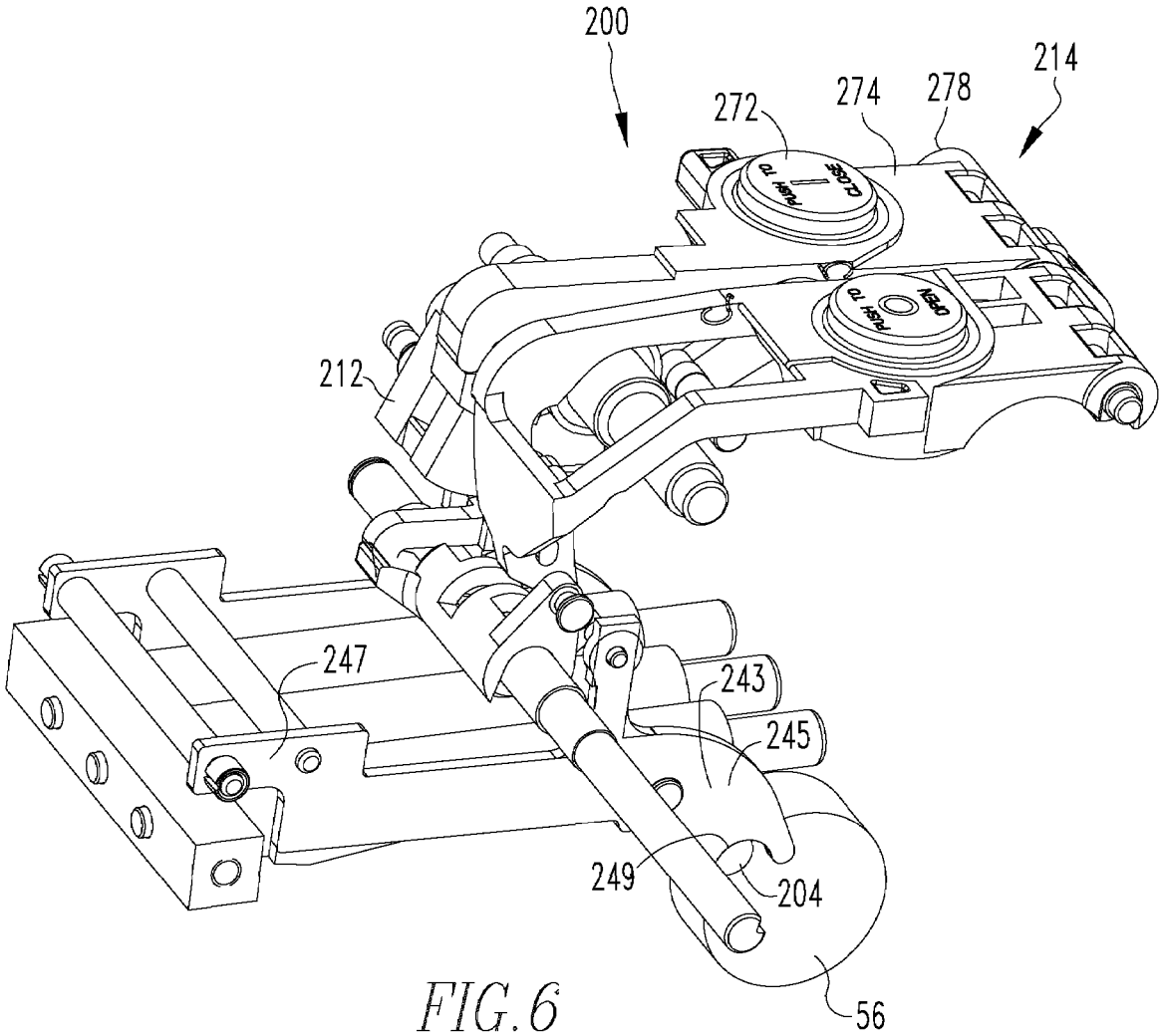
FIG. 6 is an isometric view of the interlock assembly.

As shown in FIG. 1, an electrical switching apparatus 10 includes a housing assembly 12 defining an enclosed space 14. In FIG. 1, the front cover of the housing assembly 12 is not shown, but it is well known in the art. The electrical switching apparatus 10 further includes a conductor assembly 20 (shown schematically) having at least one line terminal 22, at least one line conductor 24, at least one pair of separable contacts 26, at least one load conductor 28 and at least one load terminal 30. The at least one pair of separable contacts 26 include a fixed contact 32 and a movable contact 34. The movable contact 34 is structured to move between a first, open position, wherein the contacts 32, 34 are separated, and a second, closed position, wherein the contacts 32, 34 contact each other and are in electrical communication. The electrical switching apparatus 10 further includes a trip device 40 and an operating mechanism 50. The operating mechanism 50, which is discussed in more detail below, is generally structured to move the at least one pair of separable contacts 26 between the first, open position and the second, closed position. The trip device 40 is structured to detect an over current condition and, upon detecting such a condition, to actuate the operating mechanism 50 to open the at least one pair of separable contacts 26. The trip device 40 includes a trip shaft 42 (FIG. 6) with a radially extending paddle 44. The trip device shaft 42 is structured to operate with the interlock assembly 200, described below. The trip device shaft 42 is structured to rotate between a first open, position and a second, closed position. When the trip device shaft 42 is in the first open, position, the at least one pair of separable contacts 26 are open, or moved into the open position. When the trip device shaft 42 is in the second, closed position, the at least one pair of separable contacts 26 may be moved into the second, closed position.

The electrical switching apparatus 10 also includes at least two, and typically a plurality, of side plates 27. The side plates 27 are disposed within the housing assembly 12 in a generally parallel orientation. The side plates 27 include a plurality of openings 29 to which other components may be attached or through which other components may extend. As discussed below, the openings 29 on two adjacent side plates 27 are typically aligned. While side plates 27 are the preferred embodiment, it is understood that the housing assembly 12 may also be adapted to include the required openings and/or attachment points thereby, effectively, incorporating the side plates 27 into the housing assembly 12 (not shown).

An electrical switching apparatus 10 may have one or more poles, that is, one or more pairs of separable contacts 26 each having associated conductors and terminals. As shown in the Figures, the housing assembly 12 includes three chambers 13A, 13B, 13C each enclosing a pair of separable contacts 26 with each being a pole for the electrical switching apparatus 10. A three-pole configuration, or a four-pole configuration having a neutral pole, is well known in the art. The operating mechanism 50 is structured to control all the pairs of separable contacts 26 within the electrical switching apparatus 10. Thus, it is understood selected elements of the operating mechanism 50, such as, but not limited to, the pole shaft 56 (discussed below) span all three chambers 13A, 13B, 13C and engage each pair of separable contacts 26. The following discussion, however, shall not specifically address each specific pair of separable contacts 26.

As shown in FIG. 2, the operating mechanism 50 includes an opening assembly 52, structured to move the at least one pair of separable contacts 26 from the second, closed position to the first, open position, and a closing assembly 54, structured to move the at least one pair of separable contacts 26 from the first, open position to the second closed position. The opening assembly 52 and the closing assembly 54 both utilize common components of the operating mechanism 50. The opening assembly 52 is not part of the claimed invention, however, for the purpose of the following discussion, it is understood that the opening assembly 52 is the assembly structured to move various components to the positions discussed below. Further, it is noted that the opening assembly 52 includes a cradle assembly 53 that, among other functions, acts as a toggle stop and as a toggle kicker for the toggle assembly 58 (discussed below).

Figure 2A:
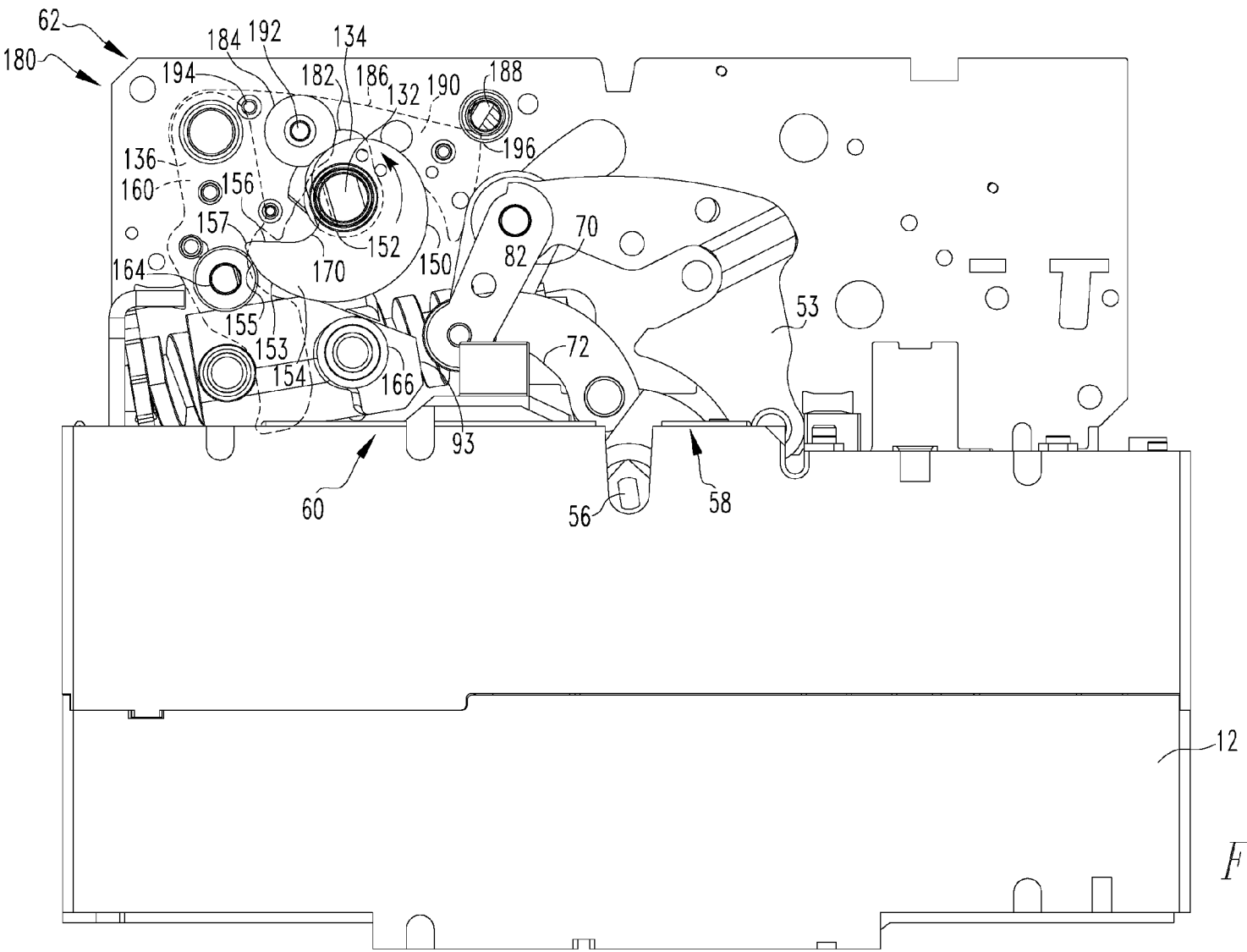
FIG. 2A is a side view of an electrical switching apparatus with a front cover removed and selected components removed for clarity and with the latch assembly in a first position.
Figure 2B:
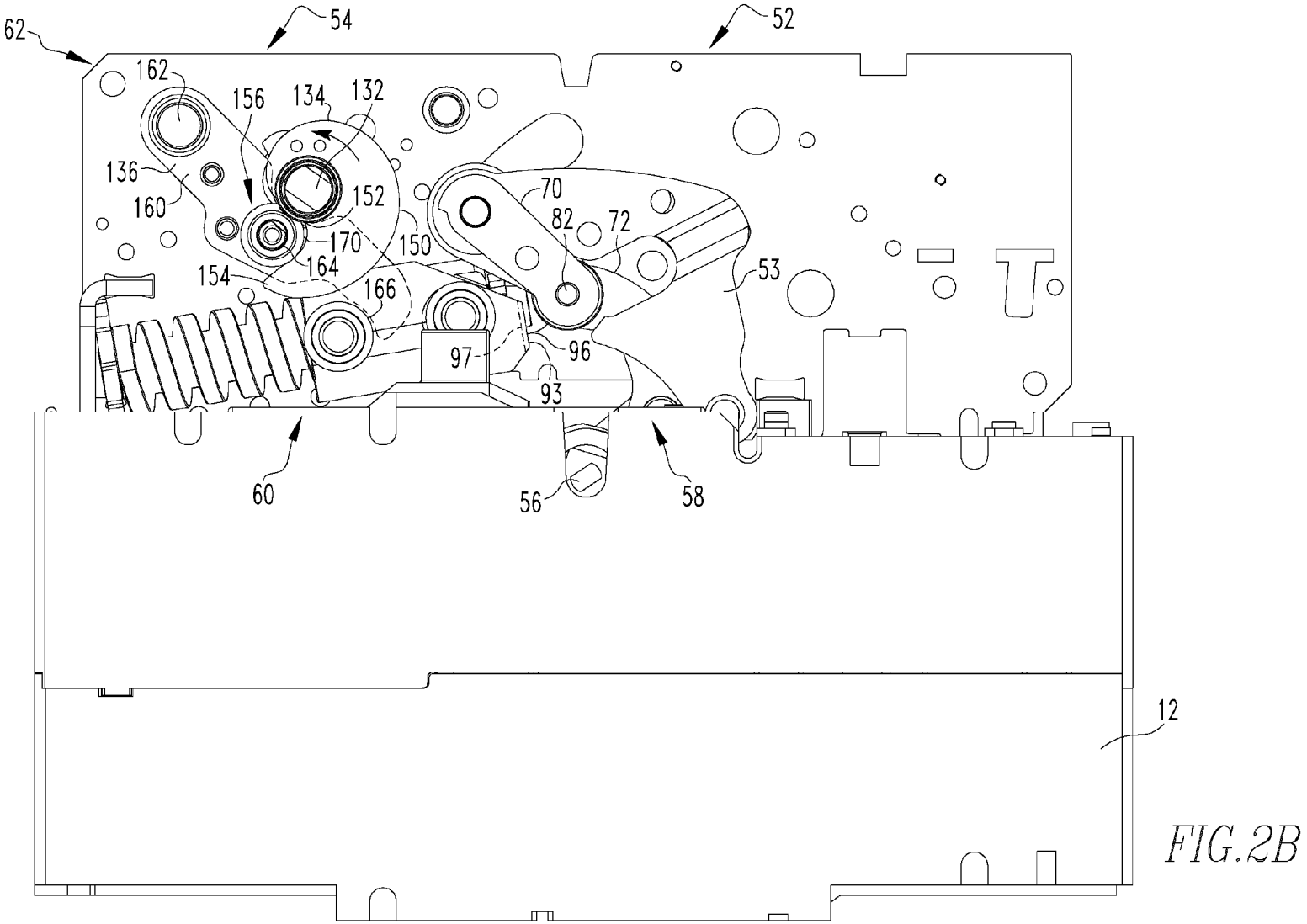
FIG. 2B is a side view of an electrical switching apparatus with a front cover removed and selected components removed for clarity and with the latch assembly in a second position.
Figure 3:
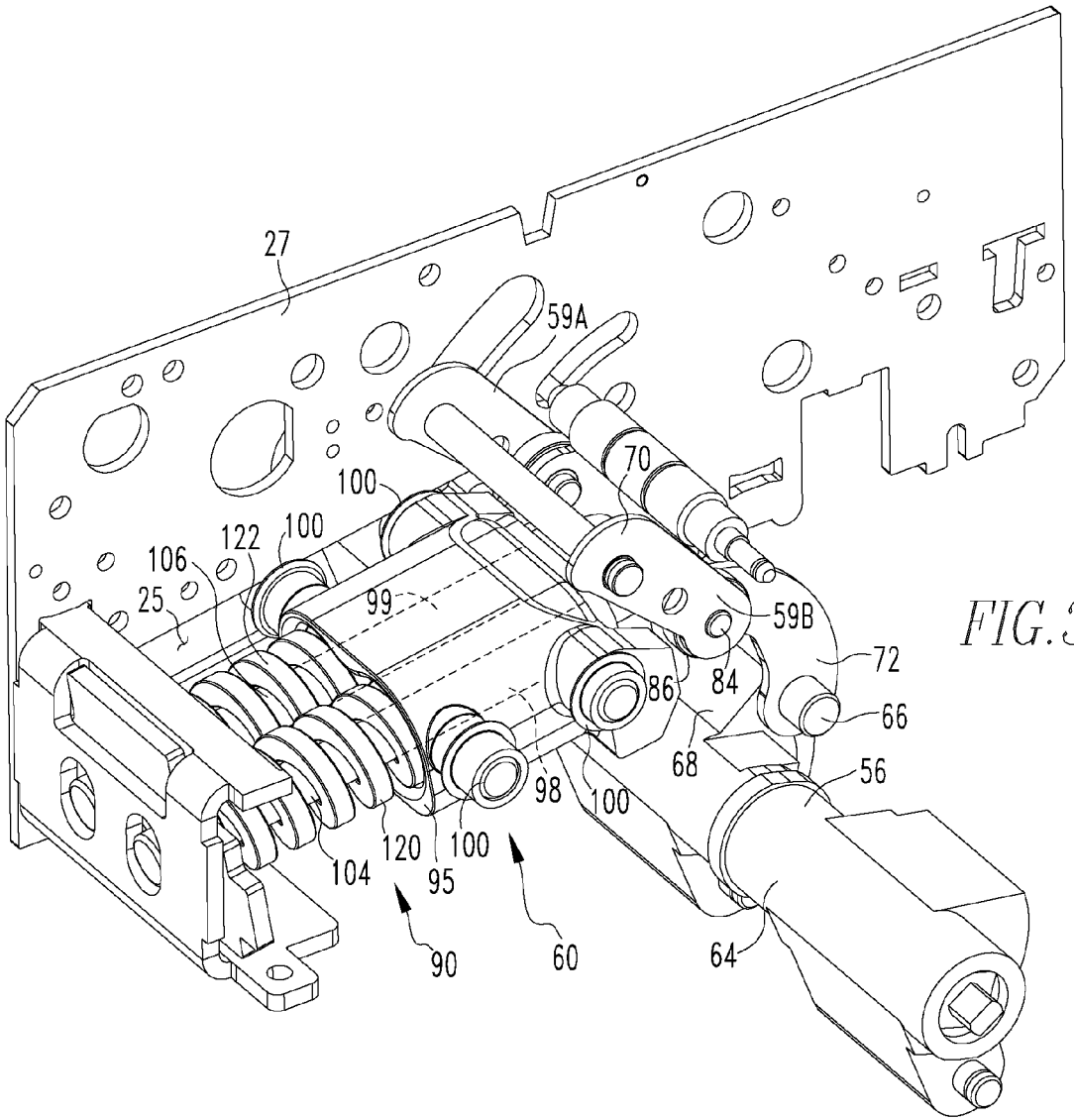
FIG. 3 is an isometric view of the closing assembly with a side plate removed for clarity.
Figure 4:
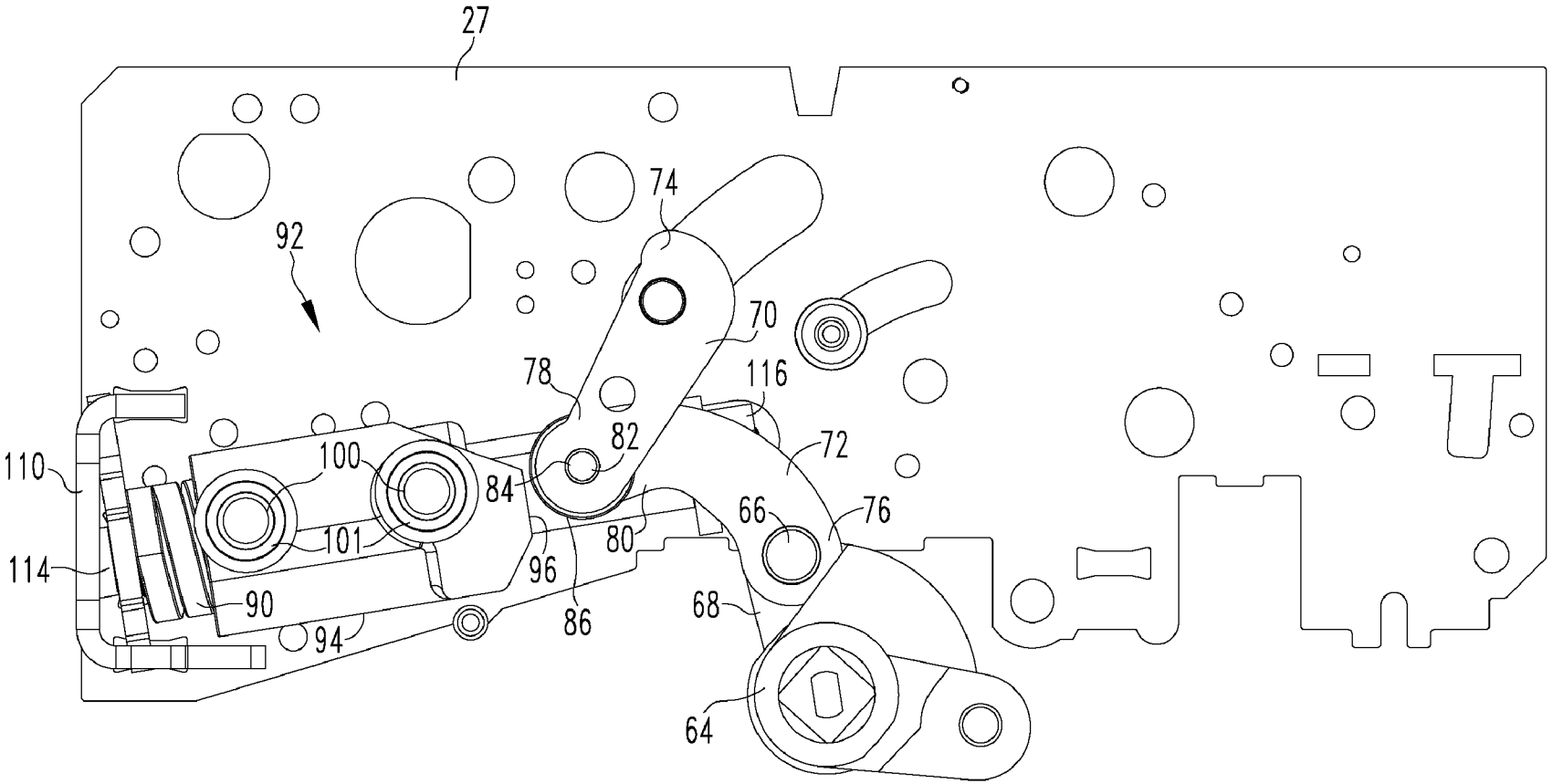
FIG. 4 is a side view of the ram assembly and the toggle assembly in a first position/configuration.

As shown in FIGS. 2-4, the closing assembly 54 includes a pole shaft 56, a toggle assembly 58, a ram assembly 60, and a charging assembly 62 (FIG. 1). The pole shaft 56 is an elongated shaft body 64 rotatably coupled to the housing assembly 12 and/or side plates 27. The pole shaft 56 includes a plurality of mounting points 66 disposed on mounting blocks 68 extending from the pole shaft body 64. The pole shaft 56 is coupled to the movable contact 34. The pole shaft 56 is structured to move between a first position, wherein the movable contact 34 is in its first, open position, and a second position, wherein the movable contact 34 is in its second, closed position.

It is noted that, as shown in FIG. 3, a single "link" in the toggle assembly 58 may include two, or more, members 59A, 59B with similar shapes which are held in a spaced relationship and which move in concert. The use of multiple link members 59A, 59B may be used, for example, to provide added strength to the link or where space considerations do not allow for a single thick link. Because these link members 59A, 59B perform the same function, have a similar shape, and move in concert, the following discussion will simply identify the link by a single reference number as is shown in the side views of FIGS. 4 and 5. It is understood that the description of a link applies to both link members 59A, 59B. Other components in the closing assembly 54 may also be constructed using various laminations or layers which sandwich each other. It is further understood that these components, such as, but not limited to, the toggle assembly members 59A, 59B and the rocker arm assembly body 160 (discussed below) each move in their own plane. The plane of travel for such components is generally parallel to the plane of the side plates 27.

Figure 5:
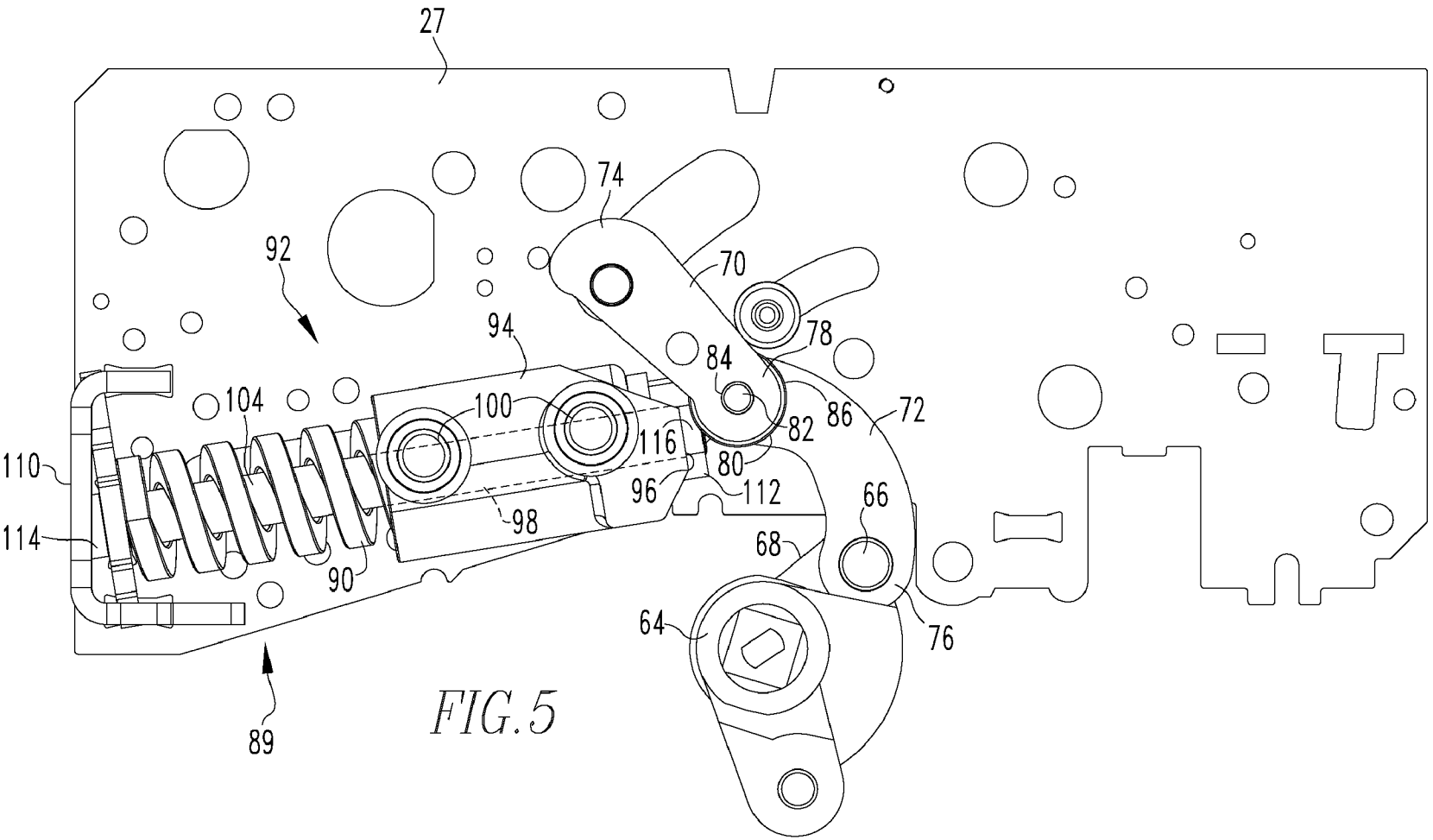
FIG. 5 is a side view of the ram assembly and the toggle assembly in a second position/configuration.

As shown in FIGS. 4 and 5, the toggle assembly 58 includes a first link 70 and a second link 72 which are each generally flat, elongated bodies. The first and second links 70, 72 each have a first, outer end 74, 76 (respectively) and a second, inner end 78, 80 (respectively). The first link 70 and the second link 72 are rotatably coupled together at the first link inner end 78 and the second link inner end 80. In this configuration, the first and second links 70, 72 form a toggle joint 82. The toggle joint 82 may include a toggle roller 86. That is, the first link inner end 78 and the second link inner end 80 may be rotatably coupled together by a pin 84 extending generally perpendicular to the plane of each link 70, 72. The pin 84 may also define an axle for the toggle roller 86 which is, essentially, a wheel. The first link outer end 74 is rotatably coupled to the housing assembly 12 and/or side plates 27. For the purpose of this disclosure, the first link outer end 74 may be considered to be a fixed pivot point. The second link outer end 76 is rotatably coupled to the pole shaft 56 and, more specifically, rotatably coupled to a mounting point 66.

It is noted that an axis extending through the pivot points for each link 70, 72 defines a line of force acting through the toggle assembly 58. The toggle assembly 58 is structured to move between a first, collapsed configuration (FIG. 4) and a second, slightly over-toggle configuration (FIG. 5). While moving between the first, collapsed configuration and the second, over-toggle configuration the toggle assembly 58 and the toggle joint 82 pass through a toggle, or in-line, configuration. In the in-line configuration, the lines of force acting through the toggle assembly 58 are aligned with each other. In the over-toggle configuration, the lines of force acting through the toggle assembly 58 are typically between about 5 degrees and 15 degrees past toggle and, preferably about 10 degrees past toggle. The toggle assembly 58 may be held in the over-toggle configuration by a stop pin 79. That is, the stop pin 79 prevents the toggle assembly 58 from collapsing in the reverse direction.

In the first, collapsed configuration, the first and second link outer ends 74, 76 are generally closer together than when the toggle assembly 58 is in the second, over-toggle configuration. Thus, because the first link outer end 74 is a fixed pivot point, as the toggle assembly 58 moves between the first, collapsed configuration and the second, over-toggle configuration, the second link outer end 76 is drawn toward, or pushed away from, the first link outer end 74. This motion causes the pole shaft 56 to move between its first and second positions. That is, when the toggle assembly 58 is in the first, collapsed configuration, the pole shaft 56 is in its first position, and, as noted above, the movable contact 34 is in its first, open position. Further, when the toggle assembly 58 is in the second, over-toggle configuration, the pole shaft 56 is in its second position, and, as noted above, the movable contact 34 is in its second, closed position.

The ram assembly 60 has at least one biasing device 89, preferably a compression spring 90, a guide assembly 92, and a ram body 94. The ram body 94, preferably, includes a generally flat forward surface 96 that is structured to engage the toggle joint 82, and more preferably the toggle roller 86. The ram body 94 may be solid but, in a preferred embodiment, the ram body 94 is substantially hollow having a loop-like side wall 95 (FIG. 3 ) coupled to cap-like a front plate 93 (FIG. 2A). The forward surface 96 is the outer surface of the front plate 93. The ram body 94 is structured to move between a first, retracted position and a second, extended position along a path of travel defined by the guide assembly 92. In one embodiment, the ram body 94 has a lateral width of about 2.1 inches and defines at least one, and preferably two passages 98, 99 (FIG. 3) extending in the direction of the path of travel. The ram body 94 may also have at least one, and preferably two rollers 100 disposed on opposite lateral sides of the ram body 94. The passages 98, 99 and the ram rollers 100 cooperate with an associated embodiment of the guide assembly 92. That is, for this embodiment, the guide assembly 92 includes at least one, and preferably two elongated, generally straight pins 104, 106 (FIG. 3) that are disposed in a spaced, generally parallel orientation. Further, the housing assembly 12 and/or side plates 27 may define slots 25 disposed on either side of the ram body 94 path of travel. When assembled, the pins 104, 106 extend through the passages 98, 99 and the ram body rollers 100 are each disposed in one of the slots 25. In this configuration, the ram body 94 is limited to a generally linear motion defined by the guide assembly 92.

The guide assembly 92 further includes a base plate 110 and a stop plate 112. Each pin 104, 106 has a base end 114 and a tip end 116. Each pin base end 114 is coupled to the base plate 110 and each pin tip end 116 is coupled to the stop plate 112 (FIG. 5). That is, the base plate 110 and the stop plate 112 maintain the pins 104, 106 in a spaced, generally parallel configuration. Further, in the embodiment described above, the base plate 110 and the stop plate 112 further limit and define the ram body 94 path of travel. That is, the ram body 94 is trapped between the base plate 110 and the stop plate 112.

The at least one spring 90 is structured to bias the ram body 94 from the first, retracted position toward the second, extended position. When the ram body 94 is in the first, retracted position, the at least one spring 90 is charged or compressed. When the ram body 94 is in the second, extended position, the at least one spring 90 is discharged. Preferably, the at least one spring 90 is disposed between the base plate 110 and a ram body back surface 97 (FIG. 2B). The ram body back surface 97 is, preferably, the interior side of the front plate 93. That is, the ram body back surface 97 is disposed on the opposite side of the front plate 93 from the forward surface 96. In the embodiment disclosed above, i.e., a ram body 94 with two passages 98, 99 and two pins 104, 106, the at least one spring 90 is preferably two springs 120, 122 and each spring 120, 122 is disposed about one of the two pins 104, 106. For a 600 volt electrical switching apparatus, wherein the closing energy required to close three pairs of contacts 26 is as much as 50 joules, the springs 120, 122 may each be about 3.5 inches long and about 0.75 inches in diameter.

As shown in FIGS. 1 and 2, the charging assembly 62 includes a charging operator 130, a cam shaft 132, a cam 134, and a rocker arm assembly 136. The charging operator 130 is a device coupled to, and structured to rotate, the cam shaft 132. The charging operator 130 may be a manually powered handle assembly 140 and/or a powered motor 142 as shown in FIG. 1. The cam shaft 132 is an elongated shaft that is rotatably coupled to the housing assembly 12 and/or side plates 27. The cam 134 is fixed to the cam shaft 132 and structured to rotate therewith about a pivot point. The cam 134 includes an outer cam surface 150. The outer cam surface 150 has a point of minimal radius 152, a point of greatest radius 154, and a stop radius 155. The cam 134 is structured to rotate in a single direction as indicated by the arrow in FIG. 2. The outer cam surface 150 increases gradually in radius from the point of minimal radius 152 to the point of greatest radius 154 in the direction of rotation. After the cam point of greatest radius 154, the radius of the outer cam surface 150 is reduced slightly over a downslope 153. The downslope 153 leads to a stop radius 155 and then a tip 157. As set forth below, the downslope 153 to the stop radius 155 is a surface to which the force from the at least one spring 90 is applied and which encourages rotation in the proper direction so that when the "close latch" releases the cam shaft 132 rotates from the stop radius 155 to the cam tip 157 where the cam follower 164 falls off the cam tip 157 and into the pocket of the cam 134. As is shown, the outer cam surface point of minimal radius 152 and the outer cam tip 157 are disposed immediately adjacent to each other on the outer cam surface 150. Thus, there is a step 156 between the point of minimal radius 152 and the cam tip 157. It is further noted that, due to the radius of the cam follower 164 (discussed below) the cam follower 164 does not engage the point of minimal radius 152, but rather engages a stop adjacent to the point of minimal radius 152.

The rocker arm assembly 136 includes an elongated body 160 having a pivot point 162, a cam follower 164, and a ram body contact point 166. The rocker arm assembly body 160 is pivotally coupled to housing assembly 12 and/or side plates 27 at the rocker arm body pivot point 162. The rocker arm assembly body 160 may rotate about the rocker arm body pivot point 162 and is structured to move between a first position, wherein the rocker arm body ram body contact point 166 is disposed adjacent to the base plate 110, and a second position, wherein the rocker arm body ram body contact point 166 is adjacent to the stop plate 112. As used immediately above, "adjacent" is a comparative adjective relating to the positions of the rocker arm assembly body 160. The rocker arm body ram body contact point 166 is structured to engage and move the ram body 94. As shown, the rocker arm body ram body contact point 166 engages a bearing 101 (FIG. 3) disposed about the axle of one of the ram body rollers 100. The rocker arm assembly body 160 moves within a plane that is generally parallel to the ram body 94 path of travel and, more preferably, in a plane generally parallel to the plane of the side plates 27. The rocker arm body cam follower 164 extends generally perpendicular to the longitudinal axis of the rocker arm assembly body 160 and is structured to engage the outer cam surface 150. The rocker arm body cam follower 164 may include a roller 170.

The closing assembly 54 is assembled in the housing assembly 12 as follows. The toggle assembly 58 is disposed with the first link outer end 74 being rotatably coupled to the housing assembly 12 and/or side plates 27. The second link outer end 76 is rotatably coupled to the pole shaft 56 and, more specifically, rotatably coupled to a mounting point 66. The ram assembly 60 is disposed adjacent to the toggle assembly 58 with the ram body forward surface 96 adjacent to the toggle joint 82. That is, the toggle assembly 58 and the ram assembly 60 are positioned relative to each other so that the toggle joint 82 is disposed within the ram body 94 path of travel. More specifically, the toggle joint 82 also moves through a path as the toggle assembly 58 moves between the first, collapsed configuration and the second, over-toggle configuration. The path of the toggle joint 82 is disposed, generally, within the ram body 94 path of travel. Thus, the ram body 94 is structured to engage the toggle joint 82. In a preferred embodiment, the ram body 94 path of travel does not extend to the position of the toggle joint 82 when the toggle assembly 58 is in the second, over-toggle configuration.

The rocker arm assembly 136 is disposed within the housing assembly 12 adjacent to the ram assembly 60. More specifically, the rocker arm body ram body contact point 166 is disposed so as to contact the forward side, that is the side opposite the at least one spring 90, of a ram body roller 100. In this configuration, rotation of the cam 134 causes the ram body 94 to move between the second, extended position and the first, retracted position. That is, assuming the ram body 94 is in the second, extended position and the cam follower 164 is disposed on the outer cam surface 150 at a point adjacent to the outer cam surface point of minimal radius 152, then the rocker arm assembly body 160 is in the second position. Upon actuation of the charging operator 130, the cam shaft 132 and the cam 134 rotate causing the cam follower 164 to move over the outer cam surface 150. At the point where the cam follower 164 engages the outer cam surface 150, the relative radius of the outer cam surface 150 increases with the continued rotation. As the relative radius of the outer cam surface 150 is increasing the rocker arm assembly body 160 is moved to the first position. As the rocker arm assembly body 160 is moved to the first position, the rocker arm body ram body contact point 166 engages the ram body bearing 101 and moves the ram body 94 to the first position, thereby compressing the at least one spring 90. When the ram body 94 is moved to the first position, the rocker arm body cam follower 164 is disposed at the stop radius 155. When the rocker arm body cam follower 164 is disposed on the stop radius 155, the force from the at least one spring 90 is transferred via the ram body 94 and the rocker arm assembly body 160 to the cam 134. That is, the force is being applied in a generally radially inward direction. Because the cam radius at the stop radius 155 is less than at the cam point of greatest radius 154, the cam 134 is encouraged to rotate away from the cam point of greatest radius 154, i.e. toward the step 156. The rotation of the cam shaft 132 is controlled by the latch assembly 180, discussed below.

In this position, any further rotation of the cam 134 will allow the rocker arm body cam follower 164 to fall over the step 156. After the rocker arm body cam follower 164 falls over the step 156, the rocker arm body cam follower 164 does not operatively engage the cam 134. That is, while there may be some minor force applied to the cam 134 by the rocker arm body cam follower 164, this force is not significant, does not cause the cam 134 to rotate, and does not cause significant wear and tear on the cam 134. It is noted that the cam 134 may rotate due to momentum imparted by the rocker arm body cam follower 164 prior to the rocker arm body cam follower 164 to falling over the step 156. Further, as the rocker arm body cam follower 164 falls over the step 156, the rocker arm assembly body 160 is free to move to the second position as the rocker arm body cam follower 164 is now disposed adjacent to the outer cam surface point of minimal radius 152. It is observed that, when the rocker arm body cam follower 164 is disposed at the outer cam surface stop radius 155, the cam 134 engaging the rocker arm assembly 136, which further engages the ram assembly 60, maintains the at least one spring 90 in the charged state.

The cam 134 and the rocker arm assembly 136 are maintained in the charged configuration by a latch assembly 180. The latch assembly 180 includes a latch lobe 182, a latch roller 184, latch prop 186 and a latch D-shaft 188. The latch lobe 182 is fixed to the cam shaft 132 and maintains a specific orientation relative to the cam 134. The latch roller 184 is rotatably coupled to the latch prop 186 and is structured to roll over the surface of the latch lobe 182. The latch prop 186 has an elongated, generally flat body 190 having a latch roller 184 mounting 192, a pivot point 194 and a latch edge 196. The latch prop body 190 is pivotally coupled to a side plate 27 and is structured to pivot, or rock, between a first position (FIG. 2A) and a second position (FIG. 2B). In the first position, the latch edge 196 engages the outer diameter of the latch D-shaft 188 and is held in place thereby. In turn, the latch roller 184 is held in place against the latch lobe 182 and prevents the cam shaft 132 from rotating. The latch D-shaft 188 is structured to rotate in response to a user input, e.g. actuation of an on-command paddle actuator 214, as described below. The latch D-shaft 188 rotates between a latched position and an unlatched position. When the latch D-shaft 188 rotates from the latched position to the unlatched position, the latch edge 196 passes over the latch D-shaft 188. This allows the latch prop body 190 to move into the second position. When the latch prop body 190 is in the second position, the latch roller 184 does not engage the latch lobe 182 and, due to the bias of the at least one spring 90, as discussed above, the cam shaft 132 will rotate.

In this configuration, the closing assembly 54 operates as follows. For the sake of this discussion the electrical switching apparatus 10 will be initially described in the typical condition following an over current condition. That is, the at least one pair of separable contacts 26 are in the first, open position, the pole shaft 56 is in the first position, the toggle assembly 58 is in the first configuration, the ram body 94 is in the first position and the at least one spring 90 is charged, and the rocker arm assembly body 160 is in the first position. To close the at least one pair of separable contacts 26, an operator actuates the latch assembly 180 to cause the latch D-shaft 188 to rotate as set forth above. When the cam shaft 132 is no longer retained by the latch assembly 180, the cam 134 rotates slightly so as to allow the rocker arm body cam follower 164 to fall over the step 156. When the rocker arm body cam follower 164 falls over the step 156, the rocker arm assembly body 160 is free to move to the second position as the rocker arm body cam follower 164. The rocker arm assembly body 160 preferably engages a stop (not shown) that positions the rocker arm assembly body 160 adjacent the outer cam surface 150 at a point adjacent to the outer cam surface point of minimal radius 152. At this point the at least one spring 90 is no longer restrained and the at least one spring 90 moves the ram body 94 from the first, retracted position toward the second, extended position. It is noted that the rocker arm assembly body 160 stop is positioned so as to allow the ram body 94 to travel over its full path of travel.

As the ram body 94 moves from the first, retracted position toward the second, extended position, the ram body forward surface 96 engages the toggle joint 82 and causes the toggle assembly 58 to move from the first, collapsed configuration to the second, over-toggle configuration. As noted above, the ram body 94 path of travel does not extend to the position of the toggle joint 82 when the toggle assembly 58 is in the second, over-toggle configuration. Preferably, the ram body 94 moves with sufficient speed and energy so that, when the ram body 94 reaches the end of the path of travel, the toggle assembly 58 is over toggle but not at its final over toggle resting point. Once the toggle assembly 58 is over the final over toggle point, the forces of the at least one spring 90 and whatever the remaining momentum created by the ram body 94 continue the motion of the toggle assembly 58 towards the second, over-toggle configuration, thereby creating a space between the ram body forward surface 96 and the toggle joint 82.

As the toggle assembly 58 is moved into the second, over-toggle configuration, the pole shaft 56 is also moved into its second position. As the pole shaft 56 is moved into its second position, the at least one pair of separable contacts 26 are moved from the first, open position to the second closed position. At this point the closing operation is complete, however, it is preferred that the operator again engages the charging operator 130 to cause the cam 134 to rotate so that the outer cam surface point of greatest radius 154 again engages the cam follower 164. As described above, the rotation of the cam 134 to this position acts to charge the at least one spring 90. Thus, the at least one spring 90 is charged and ready to close the at least one pair of separable contacts 26 following another over current condition.

The at least one spring 90 is a stored energy mechanism. To prevent the release of the stored energy within the at least one spring 90 the electrical switching apparatus 10 preferably includes a stored energy device interlock assembly 200 as shown in FIGS. 6-12. The interlock assembly 200 may be structured to operate with any stored energy mechanism within the electrical switching apparatus 10, however, the following description shall address the at least one spring 90 of the closing assembly 54. It is further noted that, as with the toggle members 59A, 59B, the interlock assembly 200 may be constructed from several laminated layers and that perform the same function, have a similar shape, and move in concert. Preferably, the interlock assembly 200 includes a single latch D-shaft link assembly 210 (described below) disposed between two on-command paddle assembly bodies 250 (described below).

Initially, it is noted that the latch D-shaft 188 includes a radially offset pivot coupling 202. Further, at least one of the pole shaft mounting points 66 is also a radially offset pivot coupling 204. The interlock assembly 200 includes a latch D-shaft link assembly 210, an on-command paddle assembly 212, and an on-command paddle actuator 214. The latch D-shaft link assembly 210 includes an elongated body 220 with a first end 222 and a second end 224. The latch D-shaft link assembly body first end 222 has a pivot coupling 226. The latch D-shaft link assembly body second end 224 is, preferably, shaped as a nose 228 having a rounded distal tip 230 and a lifting surface 232 extending from the nose tip 230 toward the latch D-shaft link assembly body first end 222. The latch D-shaft link assembly body 220 may also include a trip device extension 240 having a proximal end 242 and a distal end 244. The latch D-shaft link assembly body trip device extension proximal end 242 is coupled to the latch D-shaft link assembly body 220. The latch D-shaft link assembly body trip device extension distal end 244 is structured to engage the trip shaft paddle 44. Preferably, the latch D-shaft link assembly body trip device extension distal end 244 extends generally parallel to, but spaced from, the latch D-shaft link assembly body nose 228. The latch D-shaft link assembly 210 may also include a biasing device 231 which is preferably a tension spring 233. The latch D-shaft link assembly 210 may also include a yoke assembly 241 having a body 243 with a first end 245 and a second end 247. The yoke assembly body first end 245 has a pivot coupling 249. The yoke assembly body second end has a lifter 251. The yoke assembly body pivot coupling 249 is structured to be pivotally coupled to the pole shaft pivot coupling 204 with the yoke assembly body lifter 251 extending toward, and adjacent to, the latch D-shaft link assembly body 220, as described below. It is further noted that the body lifter 251 may be an independent element structured to be coupled to the cam shaft 132, however, this is not the preferred embodiment.

Figure 7:
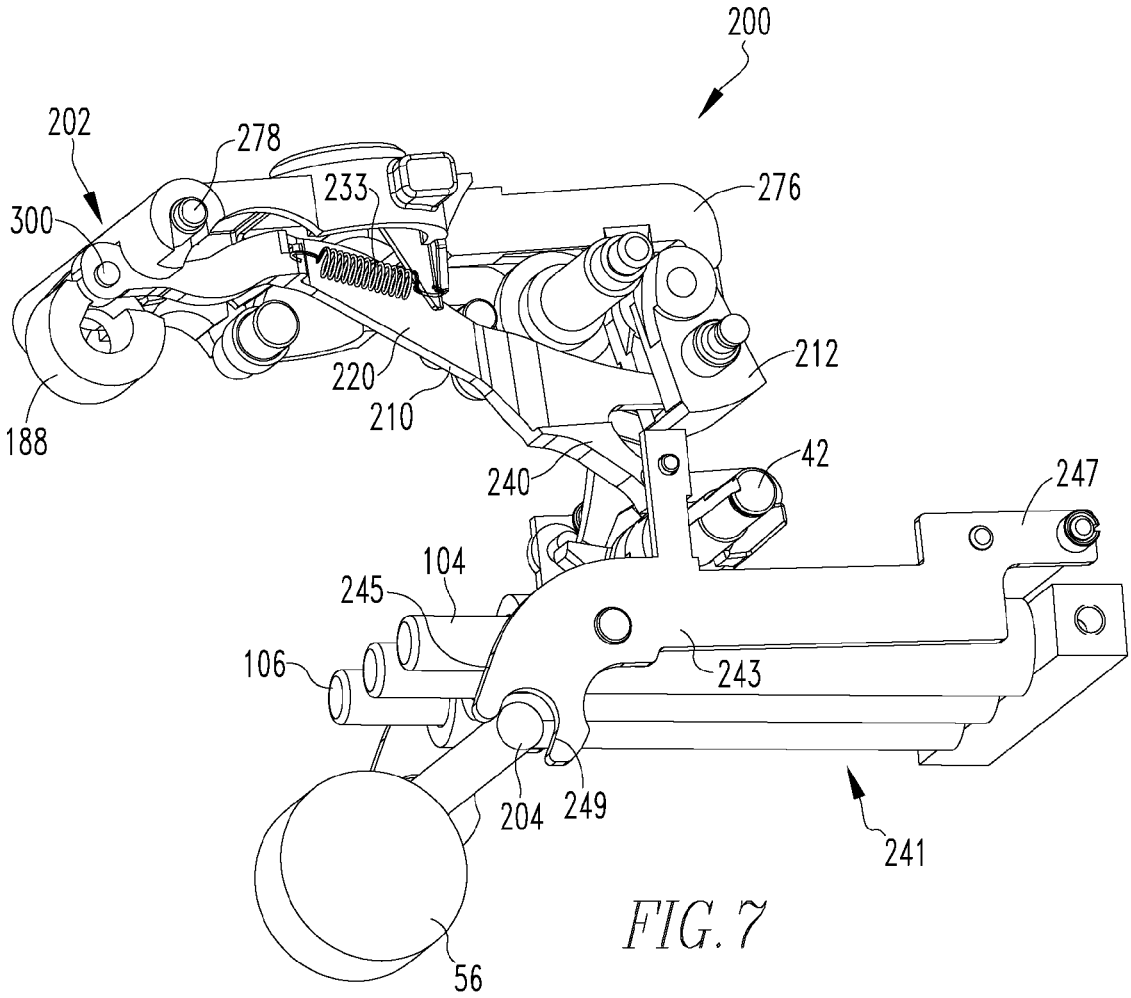
FIG. 7 is another isometric view of the interlock assembly.
Figure 8:
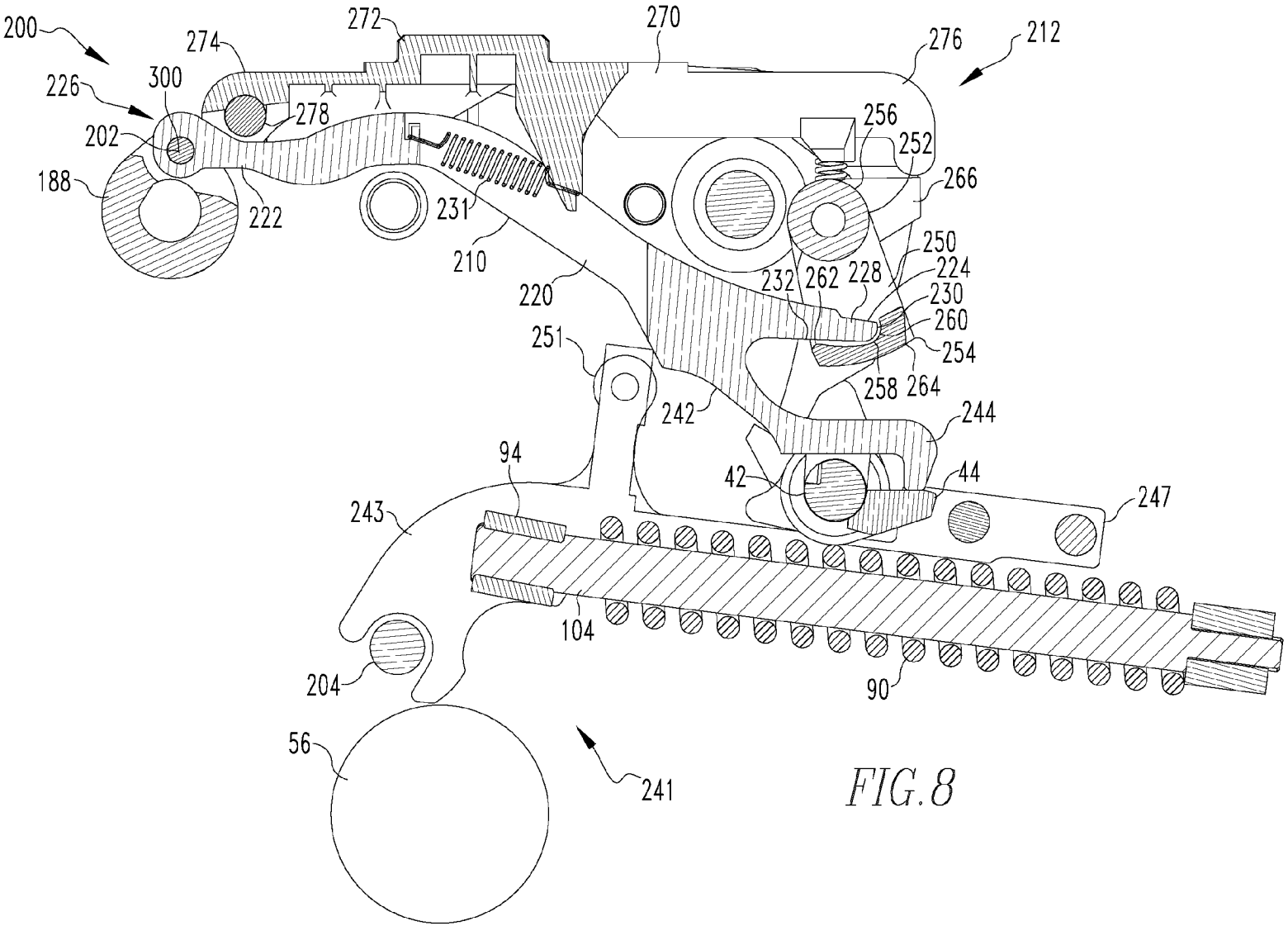
FIG. 8 is a schematic side view of the interlock assembly with the on-command paddle assembly in a first position.

As seen best in FIGS. 7 and 8, the on-command paddle assembly 212 includes an elongated body 250 with a first end 252 and a second end 254. The on-command paddle assembly body first end 252 has a pivot coupling 256. The on-command paddle assembly body second end 254 defines a pocket 258 having an open side. That is, the on-command paddle assembly body pocket 258 includes a generally radially extending pushing surface 260 and a generally circumferentially extending lifting surface 262. The on-command paddle assembly body pushing surface 260 and the on-command paddle assembly body lifting surface 262 typically meet at a vertex 264 which, preferably, has a rounded interior surface. It is noted that the on-command paddle assembly body pushing surface 260 and the on-command paddle assembly body lifting surface 262 may not actually be joined. That is, the on-command paddle assembly body pushing surface 260 and the on-command paddle assembly body lifting surface 262 may be disposed immediately adjacent to each other thereby creating a virtual vertex. The on-command paddle assembly 212 may further include an actuator tab 266 extending generally radially from the on-command paddle body first end 252.

The on-command paddle actuator 214 is structured to move the on-command paddle assembly body 250 as described below. The on-command paddle actuator 214 may be a remotely operated device, such as but not limited to, a solenoid (not shown) coupled to the on-command paddle assembly body 250. The on-command paddle actuator 214 may also include a manually operated actuator such as a button assembly 270. The button assembly 270 has a body 272 movably coupled to the housing assembly 12 and structured to move between a deactivated position and an activated position. The button assembly 270 is disposed adjacent to the on-command paddle body first end 252. More preferably, the button assembly body 272 is an elongated body having a first end 274 and a second end 276. The button assembly body first end 274 has a pivot coupling 278 structured to be pivotally coupled to the housing assembly 12. The button assembly body second end 276 is structured to engage the on-command paddle assembly actuator tab 266.

The interlock assembly 200 is assembled as follows. It is noted that the interlock assembly 200 is initially described with the latch D-shaft 188 in the latched position and the on-command paddle assembly body 250 in a deactivated position. Other configurations that the interlock assembly 200 may be moved into are described below. As shown in FIG. 8, the button assembly body first end pivot coupling 278 is pivotally coupled to the housing assembly 12. Thus, the button assembly body 272 is structured to move between a deactivated position and an activated position. The on-command paddle assembly body 250 is rotatably coupled to the housing assembly 12 adjacent to the button assembly 270. The on-command paddle assembly body 250 is structured to move through an arc between a first, deactivated position and a second, activated position. The on-command paddle assembly body 250 may be biased to the first position by a biasing device such as, but not limited to, a torsion spring (not shown). Preferably, the button assembly body second end 276 is disposed adjacent to the on-command paddle assembly actuator tab 266. When the button assembly body 272 is depressed by a user, the button assembly body second end 276 operatively engages the on-command paddle assembly actuator tab 266 and moves the on-command paddle assembly body 250 from the first, deactivated position to the second, activated position.

The latch D-shaft link assembly body first end pivot coupling 226 is coupled to the latch D-shaft pivot coupling 202 defining a latch D-shaft link pivot point 300. The latch D-shaft link assembly body second end 224, that is, the latch D-shaft link assembly body nose 228 extends into the on-command paddle assembly body pocket 258 with the latch D-shaft link assembly body lifting surface 232 extending over the on-command paddle assembly body lifting surface 262. In this configuration, the latch D-shaft link assembly body second end 224 is removably disposed within the on-command paddle assembly body pocket 258. The latch D-shaft link assembly body nose 228 is disposed immediately adjacent to, or in engagement with, the on-command paddle assembly body pushing surface 260. Preferably, the latch D-shaft link assembly biasing device 231, that is, tension spring 233, extends between the latch D-shaft link assembly body 220 and the button assembly body 272. In this configuration, the latch D-shaft link assembly biasing device 231 biases the button assembly body 272 away from the latch D-shaft link assembly body 220 and into the deactivated position. Further, the latch D-shaft link assembly biasing device 231 biases the latch D-shaft link assembly body 220 away from the button assembly body 272 and, preferably, toward the on-command paddle assembly body pocket vertex 264. Also, the latch D-shaft link assembly biasing device 231, acting through the latch D-shaft link assembly body 220 further biases the D-shaft 188 to the latched position. Further, the latch D-shaft link assembly body trip device extension distal end 244 is disposed adjacent to the trip shaft paddle 44.

The yoke assembly body first end pivot coupling 249 is pivotally coupled to the pole shaft pivot coupling 204. When the pole shaft 56 is in the first, open position the yoke assembly body lifter 251 extends toward, and adjacent to, the latch D-shaft link assembly body 220. When the pole shaft 56 is in the second, closed position, the rotation of the pole shaft pivot coupling 204 moves the yoke assembly body lifter 251 towards, and into operative engagement with, the latch D-shaft link assembly body 220, as described below.

Figure 10:
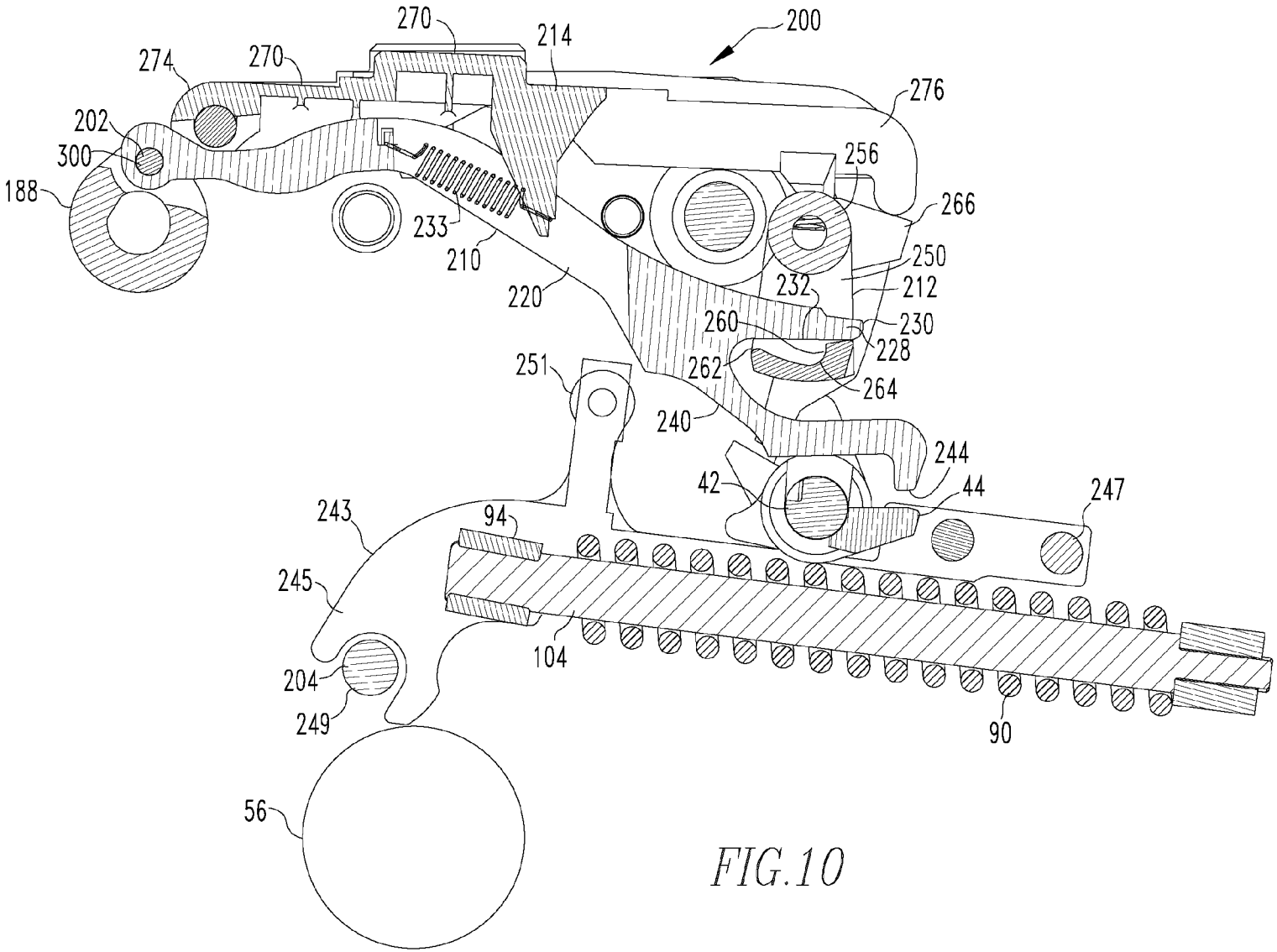
FIG. 10 is a schematic side view of the interlock assembly with the on-command paddle assembly in a second position.

In this configuration, the interlock assembly 200 allows a user to activate the closing assembly 54 and/or the latch assembly 180. That is, when a user activates the on-command paddle actuator 214 the on-command paddle assembly body 250 moves from the first, deactivated position (FIG. 8) to the second, activated position (FIG. 10). The rotation of the on-command paddle assembly body 250 moves the on-command paddle assembly body pushing surface 260 toward the latch D-shaft link assembly body 220. As the latch D-shaft link assembly body 220 moves, generally longitudinally, in a first direction, the latch D-shaft 188 also rotates about its rotational axis from the latched position to the unlatched position. As the latch D-shaft 188 rotates, the latch edge 196 passes over the latch D-shaft 188, as described above, and the closing procedure occurs. It is further noted that the rotation of the latch D-shaft 188 occurs prior to the on-command paddle assembly body 250 reaching the second, activated position. That is, the rotation of the latch D-shaft 188 occurs when the on-command paddle assembly body 250 is at a first intermediate position.

Figure 9:
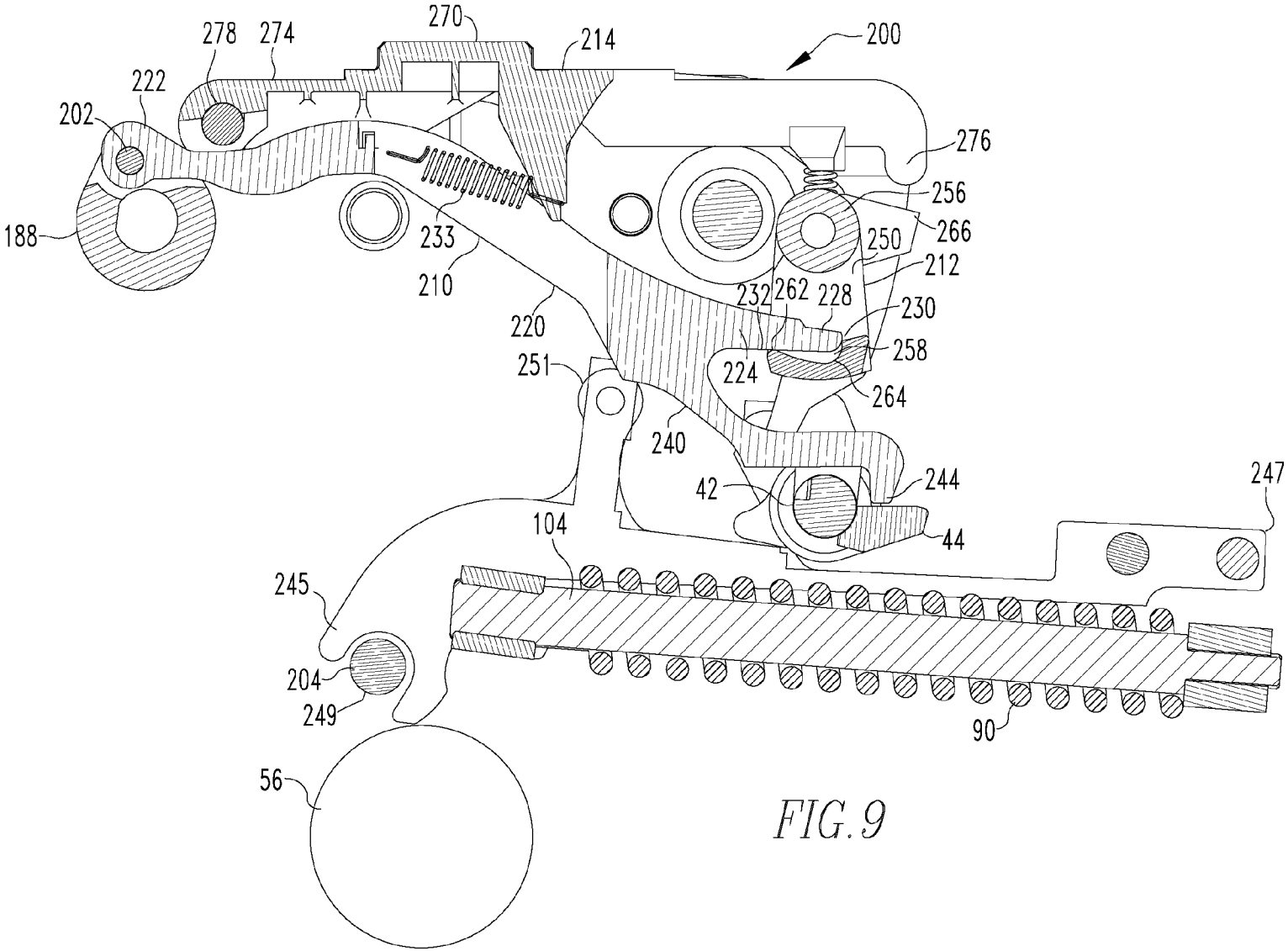
FIG. 9 is a schematic side view of the interlock assembly with the on-command paddle assembly in a first intermediate position.

As shown in FIG. 9, as the on-command paddle assembly body 250 moves from the first, deactivated position to the first intermediate position, the on-command paddle assembly body lifting surface 262 rotates towards and then operatively engages the latch D-shaft link assembly body lifting surface 232. When the on-command paddle assembly body lifting surface 262 operatively engages the latch D-shaft link assembly body lifting surface 232, the latch D-shaft link assembly body 220 rotates about the latch D-shaft link pivot point 300. This motion lifts the latch D-shaft link assembly body nose 228 out of the on-command paddle assembly body pocket 258. Once the latch D-shaft link assembly body nose 228 no longer engages the on-command paddle assembly body pushing surface 260, the latch D-shaft link assembly body 220 is no longer engaged, and/or operatively engaged, by the on-command paddle assembly body pocket 258. That is, in this position, movement of the on-command paddle assembly body 250, or even maintaining the on-command paddle assembly body 250 in the second position, e.g., by holding down the on-command paddle actuator 214, cannot cause the latch D-shaft 188 to be maintained in, or moved into, the unlatched position. That is, the bias of the latch D-shaft link assembly biasing device 231 biases the latch D-shaft link assembly body 220 away from the button assembly body 272 causing the latch D-shaft link assembly body 220 to shift to the right, as shown. As the latch D-shaft link assembly body 220 moves in the direction opposite the first direction, the latch D-shaft 188 also rotates about its rotational axis from the unlatched position toward the latched position. When the latch D-shaft link assembly body nose 228 no longer engages the on-command paddle assembly body pushing surface 260, the on-command paddle assembly body 250 is in a second intermediate position (not shown). The on-command paddle assembly body 250 may then be further rotated into the second, activated position but will not effect movement of the latch D-shaft link assembly body 220 (FIG. 10).

It is noted that, in this configuration, the interlock assembly 200 is structured to prevent a second attempt at a close procedure from occurring. That is, if a user maintains the on-command paddle assembly body 250 in the second, activated position, e.g., by holding the button assembly body 272 in the activated position, the latch D-shaft 188 will not be maintained in the unlatched position. As described above, the activation procedure results in the latch D-shaft link assembly body nose 228 being placed out of the on-command paddle assembly body pocket 258. In this configuration, there is no element acting on the latch D-shaft link assembly body 220 and shifting the latch D-shaft link assembly body 220 in the first direction. Thus, the latch D-shaft 188 is not rotated to the unlatched position but rather is free to return to and remain in the latched position. To reset the interlock assembly 200, the user must release the on-command paddle assembly body 250, e.g., by releasing the button assembly body 272. When the on-command paddle assembly body 250 is released, the on-command paddle assembly body 250 returns to the first, deactivated position. When the on-command paddle assembly body 250 returns to the first, deactivated position, the bias of the latch D-shaft link assembly biasing device 231 biases the latch D-shaft link assembly body 220 toward the on-command paddle assembly body pocket vertex 264, as set forth above. When the latch D-shaft link assembly body nose 228 is returned to the on-command paddle assembly body pocket 258, the interlock assembly 200 is reset.

Figure 11:
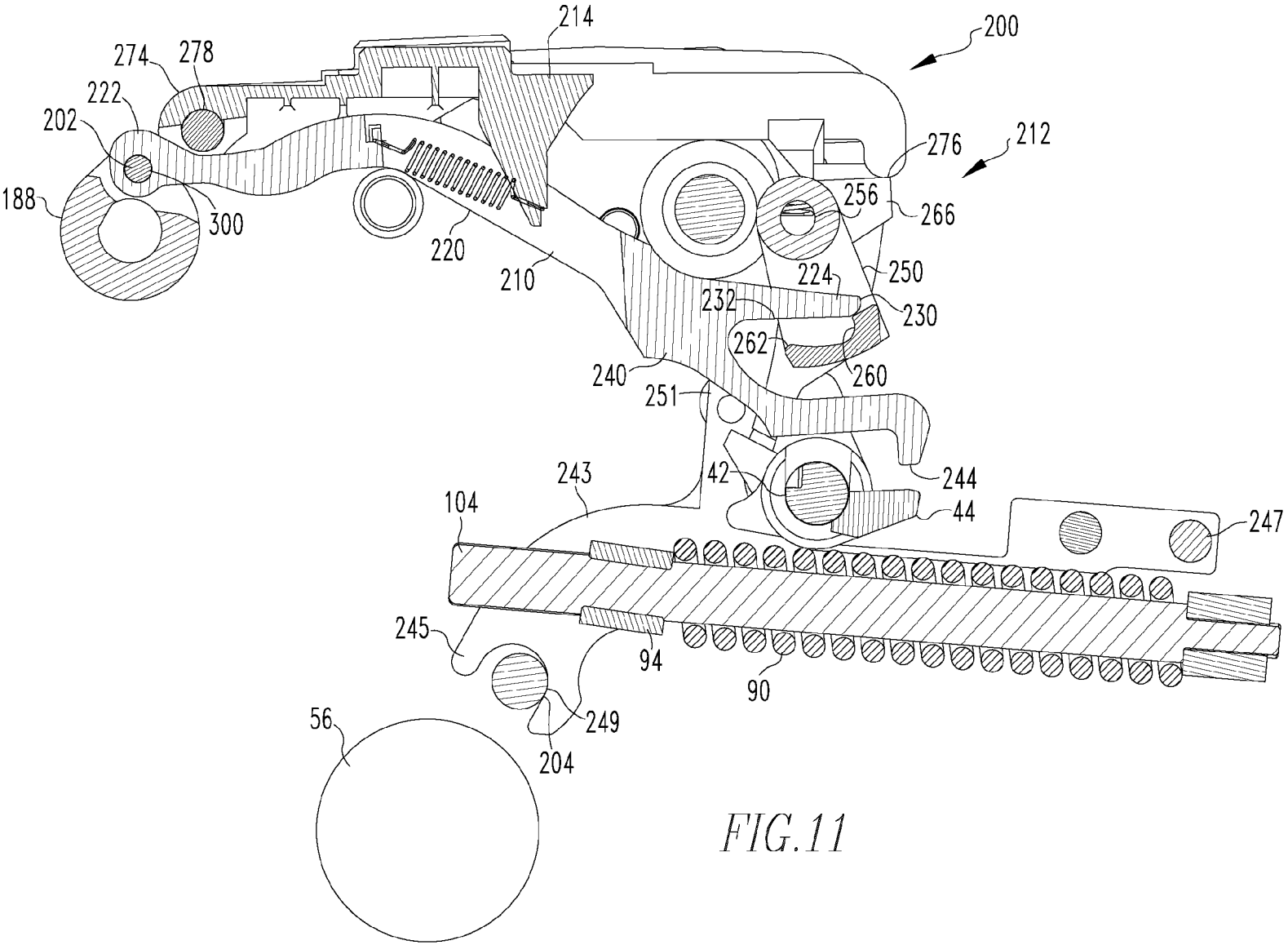
FIG. 11 is a schematic side view of the interlock assembly with the pole shaft in the second, closed position.

The interlock assembly 200 is also responsive to the position of the pole shaft 56. That is, as noted above, the pole shaft 56 rotates between a first, open position and a second, closed position. When the pole shaft 56 is in the first, open position (FIG. 8), the at least one pair of contacts 26 are open. Thus, it is acceptable to release the at least one spring 90 in order to close the at least one pair of contacts 26. However, when the at least one pair of contacts 26 are closed, releasing the at least one spring 90 would cause the ram body 94 to impact upon a stop on the guide assembly 92. This situation is avoided by having a body lifter 251 structured to be coupled to the cam shaft 132 and responsive to the position of the cam shaft 132. That is, the body lifter 251 lifts the latch D-shaft link assembly body 220 out of the on-command paddle assembly body pocket 258 when the pole shaft 132 is in the second position. Preferably, the body lifter 251 is included in a yoke assembly 241. That is, as noted above, when the pole shaft 56 is in the first, open position the yoke assembly body lifter 251 extends toward, and adjacent to, the latch D-shaft link assembly body 220. As shown in FIG. 11, when the pole shaft 56 has moved into the second, closed position, the yoke assembly body lifter 251 operatively engages the latch D-shaft link assembly body 220 and causes the latch D-shaft link assembly body nose 228 to move out of the on-command paddle assembly body pocket 258. As before, once the latch D-shaft link assembly body nose 228 no longer engages the on-command paddle assembly body pushing surface 260, the latch D-shaft link assembly body 220 is no longer engaged, and/or operatively engaged, by the on-command paddle assembly body pocket 258. That is, in this position, movement of the on-command paddle assembly body 250, or even maintaining the on-command paddle assembly body 250 in the second position, e.g., by holding down the on-command paddle actuator 214, cannot cause the latch D-shaft 188 to be maintained in, or moved into, the unlatched position. Thus, when the at least one pair of contacts 26 are closed and the pole shaft 56 is in the second, closed position, the interlock assembly 200 prevents the actuation of the on-command paddle actuator 214 from causing the rotation of the latch D-shaft 188.

The interlock assembly 200 may also be controlled by the trip device 40. As is known in the art, the trip device 40 may be maintained, or moved into, a tripped configuration by various means or devices such as, but not limited to, a racking system interlock (not shown). Such a racking system interlock is part of the racking system used to move the electrical switching apparatus 10 into, or out of, an enclosure. When the racking system is engaged, the racking system interlock engages the trip device 40 and places the trip device 40 in a tripped configuration. The interlock assembly 200 also takes advantage of the trip device 40 being in a tripped configuration to prevent the activation of the closing assembly 54 and/or the latch assembly 180.

Figure 12:
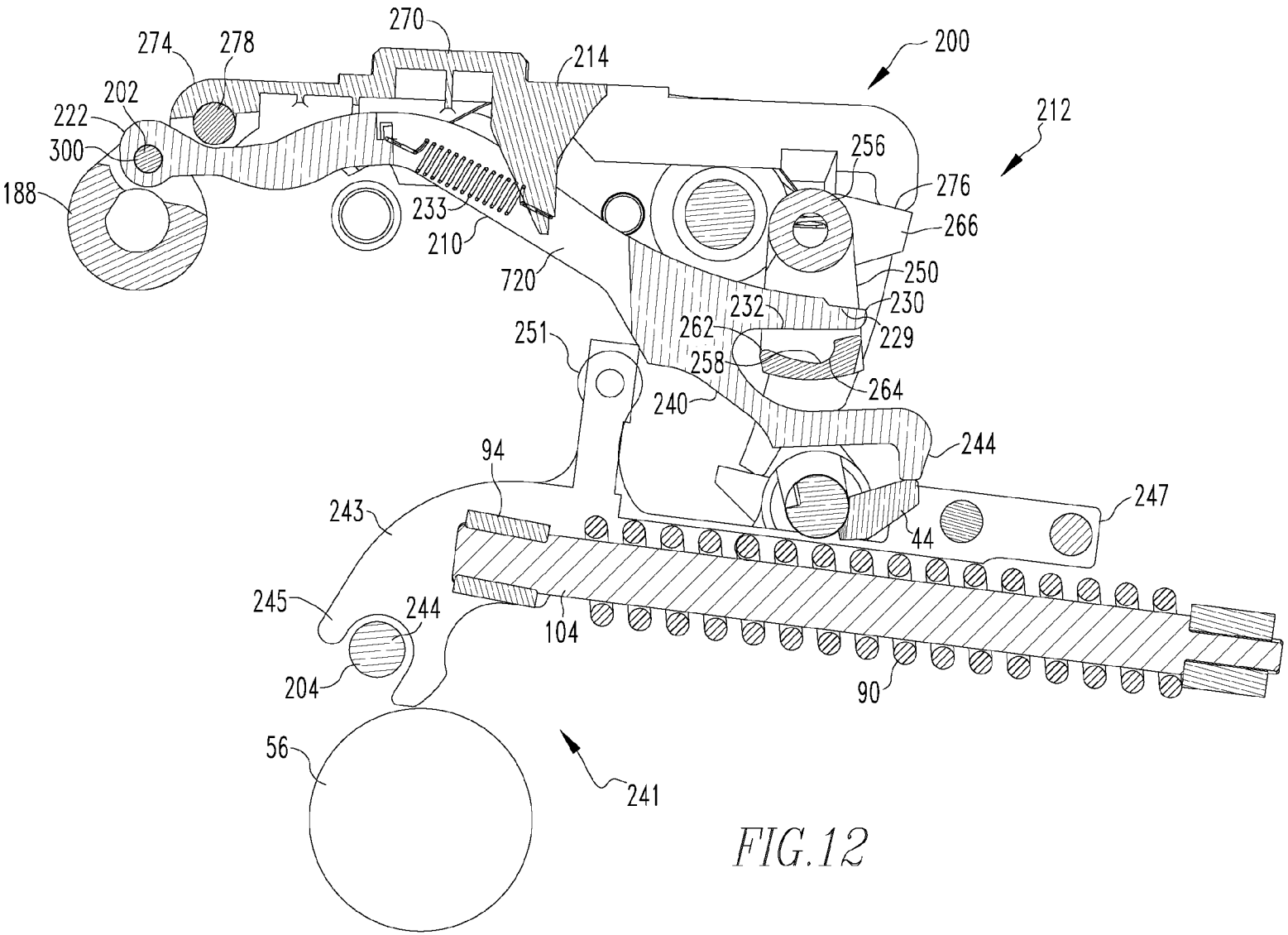
FIG. 12 is a schematic side view of the interlock assembly with the trip assembly shaft in a first open position.

That is, as noted above, the trip device 40 includes a trip device shaft 42 structured to rotate between a first open, position and a second, closed position. The trip shaft 42 radially extending paddle 44 is structured to engage, as well as operatively engage, the latch D-shaft link assembly body trip device extension distal end 244. Typically, such as when the at least one pair of contacts 26 are closed, the trip device 40 is not in a tripped configuration and the trip shaft paddle 44 does not operatively engage the latch D-shaft link assembly body trip device extension distal end 244. As shown in FIG. 8, the latch D-shaft link assembly body trip device extension distal end 244 may rest against, and be in engagement with, the trip shaft paddle 44. However, as shown in FIG. 12, when the trip device 40 is placed in a tripped configuration, the trip device shaft 42 rotates to the first open, position. Rotation of the trip device shaft 42 causes the trip shaft paddle 44 to operatively engage the latch D-shaft link assembly body trip device extension distal end 244 and move the latch D-shaft link assembly body 220. As before, the motion of the latch D-shaft link assembly body 220 causes the latch D-shaft link assembly body nose 228 to move out of the on-command paddle assembly body pocket 258. Once the latch D-shaft link assembly body nose 228 no longer engages the on-command paddle assembly body pushing surface 260, the latch D-shaft link assembly body 220 is no longer engaged, and/or operatively engaged, by the on-command paddle assembly body pocket 258. That is, in this position, movement of the on-command paddle assembly body 250, or even maintaining the on-command paddle assembly body 250 in the second position, e.g., by holding down the on-command paddle actuator 214, cannot cause the latch D-shaft 188 to be maintained in, or moved into, the unlatched position. Thus, when the trip device 40 is in a tripped configuration, the interlock assembly 200 prevents the actuation of the on-command paddle actuator 214 from causing the rotation of the latch D-shaft 188.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. An interlock assembly for an electrical switching apparatus stored energy mechanism, said electrical switching apparatus having a housing assembly and an operating mechanism disposed therein, said operating mechanism having a latch D-shaft, said latch D-shaft structured to rotate between a first latched position and a second released position wherein said latch D-shaft defines a pivot point, said latch D-shaft having a radially offset pivot coupling, said interlock assembly comprising:

a latch D-shaft link assembly having an elongated body with a first end and a second end, said latch D-shaft link assembly body first end having a pivot coupling;

said latch D-shaft link assembly pivot coupling coupled to said latch D-shaft pivot coupling thereby creating a latch D-shaft link pivot point;

an on-command paddle assembly having an elongated body with a first end and a second end, said on-command paddle assembly body first end having a pivot coupling, said on-command paddle assembly body second end defining a pocket, said on-command paddle assembly body pivot coupling being coupled to said housing assembly, whereby said on-command paddle assembly body rotates between a first, deactivated position and a second, activated position;

an on-command paddle actuator coupled to said on-command paddle and structured to move said on-command paddle assembly between said first, deactivated position and said second, activated position;

wherein said latch D-shaft link assembly body second end is removably disposed in said pocket;

wherein, as said on-command paddle assembly body rotates between a first, deactivated position and a second, activated position, said pocket operatively engages said latch D-shaft link assembly body second end and causes said latch D-shaft link to move generally longitudinally; and wherein, as said on-command paddle assembly body rotates between said first, deactivated position and a second, activated position, said latch D-shaft link moves said D-shaft between said first latched position and said second released position.

2. The interlock assembly of claim 1 wherein said latch D-shaft link has two degrees of freedom, said degrees of freedom defined by said latch D-shaft pivot point and said latch D-shaft link pivot point.

3. The interlock assembly of claim 1 wherein:

said latch D-shaft link assembly body second end defines a nose having a tip and a lifting surface;

said on-command paddle body pocket has a generally radially extending pushing surface and a generally circumferentially extending lifting surface;

wherein, when said on-command paddle body is in said first, deactivated position, said latch D-shaft link assembly body nose is removably disposed in said pocket;

wherein when said on-command paddle body is in said second, activated position, said latch D-shaft link assembly body nose does not engage said on-command paddle body pocket pushing surface; and wherein, as said on-command paddle body rotates between said first, deactivated position and said second, activated position, said on-command paddle body pocket lifting surface engages said latch D-shaft link lifting surface causing said latch D-shaft link to pivot about said latch D-shaft link second pivot point until said latch D-shaft link is moved so that latch D-shaft link assembly body nose does not engage said on-command paddle body pocket pushing surface.

4. The interlock assembly of claim 3 wherein:

said on-command paddle body pocket pushing surface and said on-command paddle body pocket lifting surface meeting at a vertex; and said latch D-shaft link assembly further includes a biasing device, said biasing device structured to bias said latch D-shaft link assembly body nose toward said vertex when said on-command paddle body is in said first, deactivated position.

5. The interlock assembly of claim 4 wherein:

said on-command paddle assembly further includes an actuator tab extending generally radially from said on-command paddle body first end;

said on-command paddle actuator includes a button assembly, said button assembly having a body movably coupled to said housing assembly and structured to move between a deactivated position and an activated position, said button assembly disposed adjacent to said on-command paddle body first end;

wherein, when said button assembly body is in said deactivated position, said button assembly body does not operatively engage said on-command paddle assembly actuator tab; and wherein, when said button assembly body is structured to operatively engage said on-command paddle assembly actuator tab and move said on-command paddle assembly body from said first, deactivated position to said second, activated position when said button assembly body is moved to activated position.

6. The interlock assembly of claim 5 wherein:

said button assembly body is an elongated body having a first end and a second end, said first end having a pivot coupling;

said button assembly body pivot coupling structured to be pivotally coupled to said housing assembly; and said button assembly body second end structured to engage said on-command paddle assembly actuator tab.

7. The interlock assembly of claim 4 wherein said operating mechanism includes a pole shaft, said pole shaft structured to move between a first position and a second position, and wherein:

said latch D-shaft link assembly includes a body lifter structured to be coupled to said pole shaft;

said body lifter extending toward, and adjacent to, said latch D-shaft link assembly body; and wherein said body lifter is structured to be moved toward said latch D-shaft link assembly body as said pole shaft moves from said first position to said second position; and wherein as said pole shaft moves from said first position to said second position, said body lifter operatively engages said latch D-shaft link assembly body and positions said latch D-shaft link assembly body nose out of said on-command paddle body pocket.

8. The interlock assembly of claim 4 wherein said operating mechanism includes a pole shaft, said pole shaft structured to move between a first position and a second position, said pole shaft having a radially offset pivot coupling, and wherein:

said latch D-shaft link assembly includes a yoke assembly having a body with a first end and a second end, said yoke assembly body first end having a pivot coupling, said yoke assembly body second end having a lifter;

said yoke assembly body pivot coupling pivotally coupled to said pole shaft pivot coupling with said yoke assembly lifter extending toward, and adjacent to, said latch D-shaft link assembly body; and wherein said yoke assembly body is structured to be moved toward said latch D-shaft link assembly body as said pole shaft moves from said first position to said second position; and wherein as said pole shaft moves from said first position to said second position, said yoke assembly lifter operatively engages said latch D-shaft link assembly body and positions said latch D-shaft link assembly body nose out of said on-command paddle body pocket.

9. The interlock assembly of claim 8 wherein said electrical switching apparatus includes a trip device, said trip device having a trip shaft with a radially extending paddle, said trip shaft structured to rotate between a first open, position and a second, closed position, and wherein:

said latch D-shaft link assembly body includes a trip device extension, said D-shaft link assembly body trip device extension having a proximal end and a distal end;

said latch D-shaft link assembly body trip device extension proximal end coupled to said latch D-shaft link assembly body;

said latch D-shaft link assembly body trip device extension distal end disposed adjacent to said trip shaft paddle; and wherein, when said trip shaft is in said first open, position, said paddle operatively engages said latch D-shaft link assembly body trip device extension distal end and positions said latch D-shaft link assembly body nose out of said on-command paddle body pocket.

10. The interlock assembly of claim 4 wherein said electrical switching apparatus includes a trip device, said trip device having a trip shaft with a radially extending paddle, said trip shaft structured to rotate between a first open, position and a second, closed position, and wherein:

said latch D-shaft link assembly body includes a trip device extension, said D-shaft link assembly body trip device extension having a proximal end and a distal end;

said latch D-shaft link assembly body trip device extension proximal end coupled to said D-shaft link assembly body;

said latch D-shaft link assembly body trip device extension distal end disposed adjacent to said trip shaft paddle; and wherein, when said trip shaft is in said first open, position, said paddle operatively engages said latch D-shaft link assembly body trip device extension distal end and positions said latch D-shaft link assembly body nose out of said on-command paddle body pocket.

11. An electrical switching apparatus comprising:

a housing assembly;

an operating mechanism disposed within said housing assembly;

a trip device disposed within said housing assembly;

at least one pair of contacts disposed within said housing assembly, said at least one pair of separable contacts structured to move between a first, open position, wherein said contacts are separated, and a second, closed position, wherein said contacts contact each other and are in electrical communication;

said operating mechanism having a stored energy device, a toggle assembly, and a latch assembly;

said pole shaft rotatably coupled to said housing assembly and structured to move between a first position and a second position, said pole shaft coupled to said movable contact and structured to move said movable contact between said first position and said second position;

said toggle assembly having a first link and a second link, said first link having an outer end and an inner end, said second link having an outer end and an inner end, said first link inner end and said second link inner end rotatabley coupled to each other forming a toggle joint, said second link outer end coupled to said pole shaft, said first link outer end coupled to said housing assembly, said toggle assembly structured to move between a first, collapsed configuration and a second, over-toggle configuration;

said stored energy device structured to act upon said toggle joint and move said toggle assembly from said first, collapsed configuration to said second, over-toggle configuration, wherein said motion of said toggle assembly causes said pole shaft to rotate from said first position to said second position, said pole shaft rotation causes said movable contact to move from said first, open position to said second, closed position;

said operating mechanism latch assembly having a latch D-shaft, said latch D-shaft structured to rotate between a first latched position and a second released position wherein said latch D-shaft defines a pivot point, said latch D-shaft having a radially offset pivot coupling;

said trip device having a trip shaft with a radially extending paddle, said trip shaft structured to rotate between a first open, position and a second, closed position;

a stored energy device interlock assembly including a latch D-shaft link assembly, an on-command paddle assembly, and an on-command paddle actuator;

said latch D-shaft link assembly having an elongated body with a first end and a second end, said latch D-shaft link assembly body first end having a pivot coupling;

said latch D-shaft link assembly pivot coupling coupled to said latch D-shaft pivot coupling thereby creating a latch D-shaft link pivot point;

said on-command paddle assembly having an elongated body with a first end and a second end, said on-command paddle assembly body first end having a pivot coupling, said on-command paddle assembly body second end defining a pocket, said on-command paddle assembly body pivot coupling being coupled to said housing assembly, whereby said on-command paddle assembly body rotates between a first, deactivated position and a second, activated position;

said on-command paddle actuator coupled to said on-command paddle and structured to move said on-command paddle assembly between said first, deactivated position and said second, activated position;

wherein said latch D-shaft link assembly body second end is removably disposed in said pocket;

wherein, as said on-command paddle assembly body rotates between a first, deactivated position and a second, activated position, said pocket engages said latch D-shaft link assembly body second end and causes said latch D-shaft link to move generally longitudinally; and wherein, as said on-command paddle assembly body rotates between said first, deactivated position and a second, activated position, said latch D-shaft link moves said D-shaft between said first latched position and said second released position.

12. The electrical switching apparatus of claim 11 wherein said latch D-shaft link has two degrees of freedom, said degrees of freedom defined by said latch D-shaft pivot point and said latch D-shaft link pivot point.

13. The electrical switching apparatus of claim 11 wherein:

said latch D-shaft link assembly body second end defines a nose having a tip and a lifting surface;

said on-command paddle body pocket has a generally radially extending pushing surface and a generally circumferentially extending lifting surface;

wherein, when said on-command paddle body is in said first, deactivated position, said latch D-shaft link assembly body nose is removably disposed in said pocket;

wherein when said on-command paddle body is in said second, activated position, said latch D-shaft link assembly body nose does not engage said on-command paddle body pocket pushing surface; and wherein, as said on-command paddle body rotates between said first, deactivated position and said second, activated position, said on-command paddle body pocket lifting surface engages said latch D-shaft link lifting surface causing said latch D-shaft link to pivot about said latch D-shaft link second pivot point until said latch D-shaft link is moved so that said latch D-shaft link assembly body nose does not engage said on-command paddle body pocket pushing surface.

14. The electrical switching apparatus of claim 13 wherein:

said on-command paddle body pocket pushing surface and said on-command paddle body pocket lifting surface meeting at a vertex; and said latch D-shaft link assembly further includes a biasing device, said biasing device structured to bias said latch D-shaft link assembly body nose toward said vertex when said on-command paddle body is in said first, deactivated position.

15. The electrical switching apparatus of claim 14 wherein:

said on-command paddle assembly further includes an actuator tab extending generally radially from said on-command paddle body first end;

said on-command paddle actuator includes a button assembly, said button assembly having a body movably coupled to said housing assembly and structured to move between a deactivated position and an activated position, said button assembly disposed adjacent to said on-command paddle body first end;

wherein, when said button assembly body is in said deactivated position, said button assembly body does not operatively engage said on-command paddle assembly actuator tab; and wherein, when said button assembly body is structured to operatively engage said on-command paddle assembly actuator tab and move said on-command paddle assembly body from said first, deactivated position to said second, activated position when said button assembly body is moved to activated position.

16. The electrical switching apparatus of claim 15 wherein:

said button assembly body is an elongated body having a first end and a second end, said first end having a pivot coupling;

said button assembly body pivot coupling structured to be pivotally coupled to said housing assembly;

said button assembly body second end structured to engage said on-command paddle assembly actuator tab.

17. The electrical switching apparatus of claim 14 wherein said operating mechanism includes a pole shaft, said pole shaft structured to move between a first position and a second position, and wherein:

said latch D-shaft link assembly includes a body lifter structured to be coupled to said pole shaft;

said body lifter extending toward, and adjacent to, said latch D-shaft link assembly body; and wherein said body lifter is structured to be moved toward said latch D-shaft link assembly body as said pole shaft moves from said first position to said second position; and wherein as said pole shaft moves from said first position to said second position, said body lifter operatively engages said latch D-shaft link assembly body and positions said latch D-shaft link assembly body nose out of said on-command paddle body pocket.

18. The electrical switching apparatus of claim 14 wherein said operating mechanism includes a pole shaft, said pole shaft structured to move between a first position and a second position, said pole shaft having a radially offset pivot coupling, and wherein:

said latch D-shaft link assembly includes a yoke assembly having a body with a first end and a second end, said yoke assembly body first end having a pivot coupling, said yoke assembly body second end having a lifter;

said yoke assembly body pivot coupling pivotally coupled to said pole shaft pivot coupling with said yoke assembly lifter extending toward, and adjacent to, said latch D-shaft link assembly body; and wherein said yoke assembly body is structured to be moved toward said latch D-shaft link assembly body as said pole shaft moves from said first position to said second position; and wherein as said pole shaft moves from said first position to said second position, said yoke assembly lifter operatively engages said latch D-shaft link assembly body and positions said latch D-shaft link assembly body nose out of said on-command paddle body pocket.

19. The electrical switching apparatus of claim 18 wherein said electrical switching apparatus includes a trip device, said trip device having a trip shaft with a radially extending paddle, said trip shaft structured to rotate between a first open, position and a second, closed position, and wherein:

said latch D-shaft link assembly body includes a trip device extension, said D-shaft link assembly body trip device extension having a proximal end and a distal end;

said latch D-shaft link assembly body trip device extension proximal end coupled to said D-shaft link assembly body;

said latch D-shaft link assembly body trip device extension distal end disposed adjacent to said trip shaft paddle; and wherein, when said trip shaft is in said first open, position, said paddle operatively engages said latch D-shaft link assembly body trip device extension distal end and positions said latch D-shaft link assembly body nose out of said on-command paddle body pocket.

20. The electrical switching apparatus of claim 14 wherein said electrical switching apparatus includes a trip device, said trip device having a trip shaft with a radially extending paddle, said trip shaft structured to rotate between a first open, position and a second, closed position, and wherein:

said latch D-shaft link assembly body includes a trip device extension, said D-shaft link assembly body trip device extension having a proximal end and a distal end;

said latch D-shaft link assembly body trip device extension proximal end coupled to said D-shaft link assembly body;

said latch D-shaft link assembly body trip device extension distal end disposed adjacent to said trip shaft paddle; and wherein, when said trip shaft is in said first open, position, said paddle operatively engages said latch D-shaft link assembly body trip device extension distal end and positions said latch D-shaft link assembly body nose out of said on-command paddle body pocket.

* * * * *